US009653062B2

(12) United States Patent
Georgiou et al.

(10) Patent No.: US 9,653,062 B2
(45) Date of Patent: May 16, 2017

(54) METHOD, SYSTEM AND ITEM

(76) Inventors: Archiveades Georgiou, Ilford (GB); Antony Zenonos, Enfield (GB)

( * ) Notice: Subject to any disclaimer, the term of this patent is extended or adjusted under 35 U.S.C. 154(b) by 1136 days.

(21) Appl. No.: 13/390,531

(22) PCT Filed: Aug. 16, 2010

(86) PCT No.: PCT/GB2010/001549

§ 371 (c)(1),
(2), (4) Date: Apr. 30, 2012

(87) PCT Pub. No.: WO2011/020992

PCT Pub. Date: Feb. 24, 2011

(65) Prior Publication Data

US 2012/0281856 A1 Nov. 8, 2012

(30) Foreign Application Priority Data

Aug. 15, 2009 (GB) ..... 0914324.9
Mar. 25, 2010 (GB) ..... 1005027.6

(51) Int. Cl.
*G10K 11/178* (2006.01)
*H04R 1/10* (2006.01)

(52) U.S. Cl.
CPC ..... *G10K 11/178* (2013.01); *H04R 1/1083* (2013.01); *G10K 2210/1081* (2013.01); *G10K 2210/3027* (2013.01)

(58) Field of Classification Search
CPC ..... G10K 11/178; G10K 11/1782; G10K 11/1784; G10K 11/1786; G10K 2210/108; G10K 2210/1081; G10K 2210/3027; H04R 1/1083; H04R 2410/05
USPC ..... 381/71.1–71.8, 94.2, 57, 74, 309
See application file for complete search history.

(56) References Cited

U.S. PATENT DOCUMENTS 5,130,665 A * 7/1992 Walden ..... 330/129
2003/0002688 A1* 1/2003 Kanevsky et al. ..... 381/74
2006/0153394 A1* 7/2006 Beasley ..... 381/57

* cited by examiner

*Primary Examiner* — David Ton
(74) *Attorney, Agent, or Firm* — The Weintraub Group, P.L.C.

(57) ABSTRACT

A method of enabling a hearer to hear desired sound while also being able to be aware of ambient sound, comprises providing a first non-sound signal representative of said desired sound, deriving a second non-sound signal from said ambient sound, combining the first and second non-sound signals in providing a third non-sound signal, and converting said third non-sound signal into sound.

31 Claims, 24 Drawing Sheets

Selective Sound Cancelling

Key:

1 - Natural Ambience
2 - Microphone
3 - Microphone Signal A*
4 - Microphone Signal B*
5 - Phase Shift
6 - Filtering processing e.g. EQ, Gate, Spectral Enhancer etc.
7 - Microphone Signals A+B Combined
8 - Audio Compressor
9 - Desired Sound e.g. Music Player
10 - Mixer
11 - Headphones

*Microphone Signals A and B are identical

Maximum Noise Cancelling Configuration

Dotted lines means the parameters can be user controlled via a software interface (see Fig. 1) or included in an external controller unit.

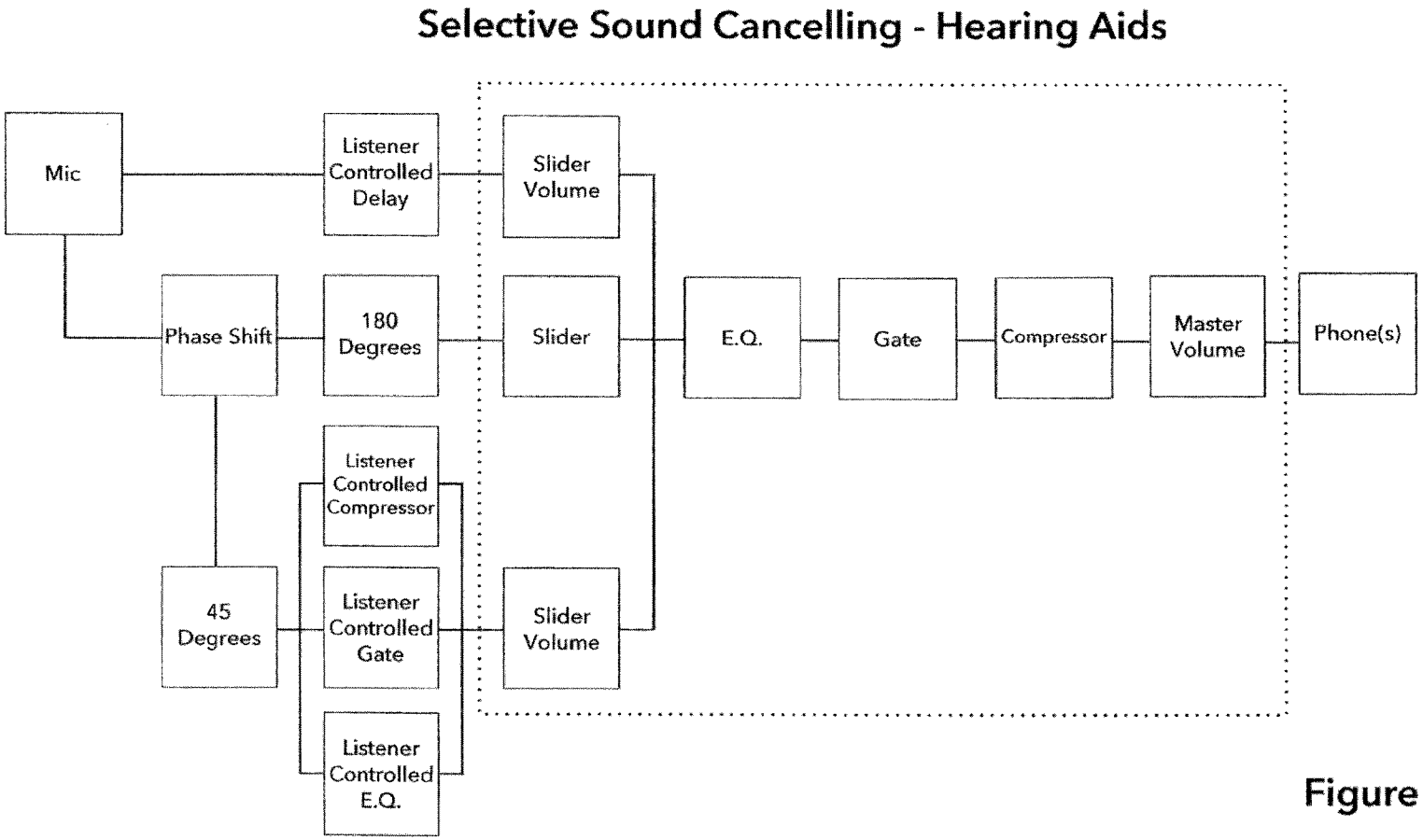

Figure 7

Note: Components enclosed by the dotted lines indicate that they could be incorporated in an external hardware module allowing users to fine tune the invention to work according to their needs or preference. Alternatively a number of presets can be pre-programmed into the hearing aid to work in a number of modes e.g. to selectively reduce unwanted ambience such as machinery, cars, trains, airplanes etc.

Key:
1 - natural Ambience
2 - microphone
3 - microphone Signal A
4 - microphone Signal B
microphone Signals A and B are identical
5 - phase invertor
6 - microphone signal A+B combined (after signal A has been inverted)
7 - desired sound e.g. music player
8 - mixer
9 - headphones

METHOD, SYSTEM AND ITEM

The invention relates to a method of, and a system for, enabling a hearer to hear desired sound while also being able to be aware of ambient sound. The invention is particularly, but not exclusively, applicable to cancelling sound, a system for, cancelling sound and an item comprising sound-cancelling apparatus.

It has become increasingly commonplace in recent years for people to listen to music and other audio supplied from mobile telephones and music players through in-ear phones or headphones which are so-called "enclosed", i.e. are significantly isolated acoustically from ambient sound. This has the disadvantage that the listener is unaware of ambient sound which he would definitely wish to hear, such as a warning of danger.

Many sound cancelling methods/applications are known in the art but generally are based on the same principle, namely, sound cancelling is achieved by creating a copy of a digital or analogue audio signal, reversing the polarity of the signal to create a corresponding 'negative' signal and then combining the two signals to achieve a total sound cancelling effect. The inherent problem with the known art is that this sound cancelling process cannot distinguish between wanted and unwanted sounds. Existing methods automatically assume that all background sound is unwanted and, therefore, are unsuitable for use as a sound cancelling system on mobile phones or on hearing aids where the user may need to be able to have a conversation or to be able to hear what is going on around him. To date, sound cancelling use has been limited because of the requirement to isolate acoustically a user who wears, for example, headphones (or earphones or headsets of any description). At present, expensive headphones/earphones are required for sound cancelling devices. Furthermore, users of hearing aids and music players, such as mp3 players, instinctively turn up the volume in their earphones to mask any unwanted ambient sound. This is disadvantageous as it can inadvertently cause damage to the user's hearing and, over a sustained period of use, may lead to permanent hearing loss.

The invention, which can be realised in mainly software or hardware form, is aimed at eliminating or significantly reducing the disadvantages of the known prior art.

Herein, the expression "non-audio" refers to transmission other than by sound waves through air, usually by electrical conduction.

According to a first aspect of the present invention, there is provided a method of enabling a hearer to hear desired sound while also being able to be aware of ambient sound, comprising providing a first non-sound signal representative of said desired sound, deriving a second non-sound signal from said ambient sound, combining the first and second non-sound signals in providing a third non-sound signal, and converting said third non-sound signal into sound.

According to a second aspect of the present invention, there is provided a system for enabling a hearer to hear desired sound while also being able to be aware of ambient sound, comprising a first outputting device for outputting a first non-sound signal representative of said desired sound, a second outputting device for outputting a second non-sound signal derived from said ambient sound, a combining arrangement for combining the first and second non-sound signal, and a converting device for emitting sound converted from said third non-sound signal.

Owing to those aspects of the invention, it is possible to enable a hearer to hear desired sound while also being able to be aware of ambient sound, especially in circumstances where, in order to listen to the desired sound, the hearer has deliberately excluded hearing most of ambient sound transmitted towards his ears through the air.

An "enclosed" headphone user equipped with a preferred embodiment of the present invention may listen to audio from any audio player or 'phone while also listening to and controlling/enhancing the level of surrounding ambient sound he hears after it has been picked up by an open microphone. The embodiment consists of a combination of audio processes, which may be employed in a number of configurations using some or all of the treatments of mixing, gating, equalizing, compressing, expanding and spectral enhancing. The user does not hear anything below a set threshold (gate), although he hears everything above it at a set maximum level (limiter/compressor), and such settings can be adjustable by the user, or pre-set by the supplier of the APP, or automatically set to a level representing the average or other ambient sound amplitude measured over a predetermined period. The embodiment preferably allows a user to:

- Hear ambient sound while using the headphones
- Set maximum audio level for ambient sound
- Hear only the ambient sound that exceeds a user-, pre-, or automatically, set threshold
- Choose either receiving a vibrate-only alarm or a visual message on the host device (e.g. MP3 player), or hearing the audio (ambience) picked up by the microphone when the threshold is exceeded
- Hear the microphone signal at any time by pressing a button
- Adjust the sensitivity of the microphone.

The embodiment may be constructed and configured in any number of alternate ways to produce versions that serve many purposes, e.g. alarm only, enhanced audio (e.g. louder), or processed to emphasise, exclude or include particular sounds or frequencies.

For example the embodiment can be configured to lower the heard music of an MP3 player and allow the user to hear the signal from the microphone when a set threshold is exceeded, or it can stop or pause the music or simply allow the microphone signal to be heard simultaneously with the music.

According to a third aspect of the present invention, there is provided a method of partially cancelling sound, comprising:

providing a first non-sound signal representative of a desired audio signal to be listened to;

providing a second non-audio signal representative of a partially-cancelling, ambient audio signal; and combining the first and second non-sound signals in providing a heard audio signal.

According to a fourth aspect of the present invention, there is provided a method of partially cancelling sound, comprising:

providing a first non-sound signal representative of a desired audio signal to be listened to;

providing a second non-sound signal derived from an ambient audio signal;

altering the phase of the second non-sound signal to provide a substantially fully cancelling, phase-altered, non-sound signal and a partially-cancelling, phase-altered non-sound signal; and combining the first non-sound signal, the substantially fully cancelling, phase-altered non-sound signal and the partially-cancelling, phase-altered non-sound signal to provide a heard audio signal.

According to a fifth aspect of the present invention, there is provided a system for partially cancelling sound, comprising:

a first outputting device for outputting a first non-sound signal representative of a desired audio signal to be listened to;

a providing device lot providing a second non-sound signal representative of a partially-cancelling, phase-altered ambient audio signal;

a combining arrangement for combining the first and second non-sound signals in providing a third non-sound signal; and a second outputting device for converting the third non-sound signal into a heard audio signal.

According to a sixth aspect of the present invention, there is provided a system for partially cancelling sound, comprising:

a first outputting device for outputting a first non-sound signal representative of a desired audio signal to be listened to;

a providing device for providing a second non-sound signal derived from an ambient audio signal;

a phase-altering arrangement for altering the phase of the second non-sound signal to provide a substantially fully cancelling, phase-altered, non-sound signal and a partially-cancelling, phase-altered non-sound signal;

a combining arrangement for combining the first non-sound signal, the substantially fully cancelling non-sound signal, and the partially-cancelling non-sound signal in providing a third non-sound signal; and a second outputting device for converting the third non-sound signal into a heard audiosignal.

According to a seventh aspect of the present invention, there is provided apparatus comprising an item consisting of any one of the group consisting of a telephone, a mobile phone, a television, a karaoke machine, a computer, a Hi-Fi, a surround-sound system, a games console, and an in-vehicle audio device, the apparatus comprising only one microphone, which is included in said item, and having a capability of playing audio files for a user to listen to, wherein the microphone is capable of detecting ambient sound and the item further comprises:

a phase-altering arrangement for altering the phase of sound detected by the microphone to provide a phase-altered non-sound signal; and a combining arrangement for combining the phase-altered non-sound signal and a representative non-sound signal representative of a desired audio signal from a stored audio file prior to a user's listening to a heard audio signal consequent upon combining of said phase-altered non-sound signal and said representative non-sound signal.

According to an eighth aspect of the present invention, there is provided a method of cancelling sound, comprising:

transmitting a desired audio signal towards a listener in a space and through air in said space containing said listener;

providing a non-sound signal representing unwanted ambient sound;

altering the phase of the non-sound signal to provide an at least partially cancelling, phase-altered non-sound signal; and combining a non-sound signal representing the desired audio signal and the at least partially cancelling, phase-altered non-sound signal to provide an audio signal received by the listener.

Owing to those aspects of the invention, it is possible for the hearer to eliminate unwanted ambient sound, typically allowing him to hear more music at lower volume, so as not to damage his hearing. Further, it is possible for the hearer to enjoy the benefits of sound cancelling without the traditional limitations and also possible to include a number of groundbreaking features that improve a host device in terms of functionality and practical use, whilst improving user health and safety for headphone/earphone/headset dependent products and utilities.

Advantageously, embodiments of the invention allow headphone/earphone/headset users to choose the ambient sounds they want to hear, if any, and at a comfortable volume. Thus, a user is able to listen to music or make a call whilst the selective sound cancelling (SSC) eliminates, or significantly reduces, unwanted background sound, whilst allowing him to hear 'naturally required ambience' such as the sound of a doorbell or an alarm. Furthermore, the user may be able to cancel, or significantly reduce, unwanted sound in any room, hall, or any venue. A typical application would be where a user wishes to cancel out any unwanted ambient sounds in a room while watching TV, listening to the radio or, even, just having a conversation. Embodiments of the invention can be incorporated into hardware such as 'phones and televisions (TVs) or used in web streaming websites (computers), or music players and systems.

Advantageously, embodiments of this invention allow a user finely to adjust the phase shift amount delay time, allowing him to make up for the natural delay time in processing the ambient audio signal, and allow compensation for the difference in the time it takes for sound to travel to the user's ear and the microphone. Preferably, some of the compressor settings may be available to a user and/or variable gate settings may be made available to the user to allow the user to determine when and how the gate acts, and for how long.

A preferred embodiment of the present invention uses the disclosed system/method and hardware and, in particular, an innovative algorithm that allows headphone users to benefit from advanced selective sound cancelling technology using standard generic headphones, whilst retaining audio awareness of immediate surroundings when so desired. Further, it allows sound cancelling to be enabled on a telephone (mobile or not) or anywhere, where two-way conversations are required—this being impossible whilst using current sound cancelling solutions.

It is possible to introduce a number of previously unavailable features to all audio devices, including mobile 'phones, mobile 'phones with music playing capacity, MP3 players, and websites (streaming), which increases the functionality and usefulness of the host device upon which embodiments of the invention are employed. Such embodiments enable the introduction of many groundbreaking benefits that are not otherwise available through the known art and which will be clearly discernable by those skilled in the art, as exemplified herein.

Embodiments of the present invention can be tailored to work on systems that depend on loud-speakers (or any other sound emitting devices). Examples of these are loud-speakers in cinemas, halls, and rooms—such as living rooms—meeting rooms and open-plan offices, in addition to open spaces. For these utilities, a number of high-quality microphones and sound reproduction loud-speakers may be used in this configuration depending on the type of sound that needs cancelling and the acoustic characteristics of the venue. The microphones are, typically, strategically placed near the sources of unwanted sound. The loud-speakers are placed around the hearer(s). Acoustic specialists can then calibrate the relevant embodiment of the invention so that it only cancels out the undesired sound and transmits both the desired sound and any desired ambient sound.

The following terms are well-known to those skilled in the art but a brief definition has been included for completeness.

'Phase shift' is where the waveform of an analogue or digital signal is altered. A 180 degree phase shift produces an inverted waveform (typically) and a 90 degree phase shift causes a partial inversion.

A 'Compressor' is a processing algorithm that limits or expands the dynamics in signals. For example, a compressor can make loud sounds quieter and quiet sounds louder. There may be variable settings that affect the threshold before the compressor acts, such as, the speed and way it acts.

A 'Gate' is an algorithm that turns a signal on and/or off. Gates may also be triggered by external sources or devices, and feature a 'side chain' facility which means other processes (such as equaliser—EQ) can add to or control the behaviour of the gate.

'EQ' is an abbreviation for equaliser, and is a process that allows the user to cut or boost particular frequencies in the frequency spectrum of a signal.

A 'Spectral Enhancer' is a process that improves the sonic quality of an audio file by adding to and manipulating harmonics, to produce a desired effect.

Other standard processes such as automatic gain control (to balance audio levels) may be used to condition the sounds to be heard—these are common procedures that have been omitted for the sake of simplicity from the embodiments shown in the accompanying drawings.

In order that the invention may be clearly and completely disclosed, embodiments thereof will now be described, by way of example only, with reference to the accompanying drawings, in which:

FIG. 7 is a schematic drawing of a sound cancelling system and shows Selective Sound Cancelling—Hearing Aids;

Figure 1:
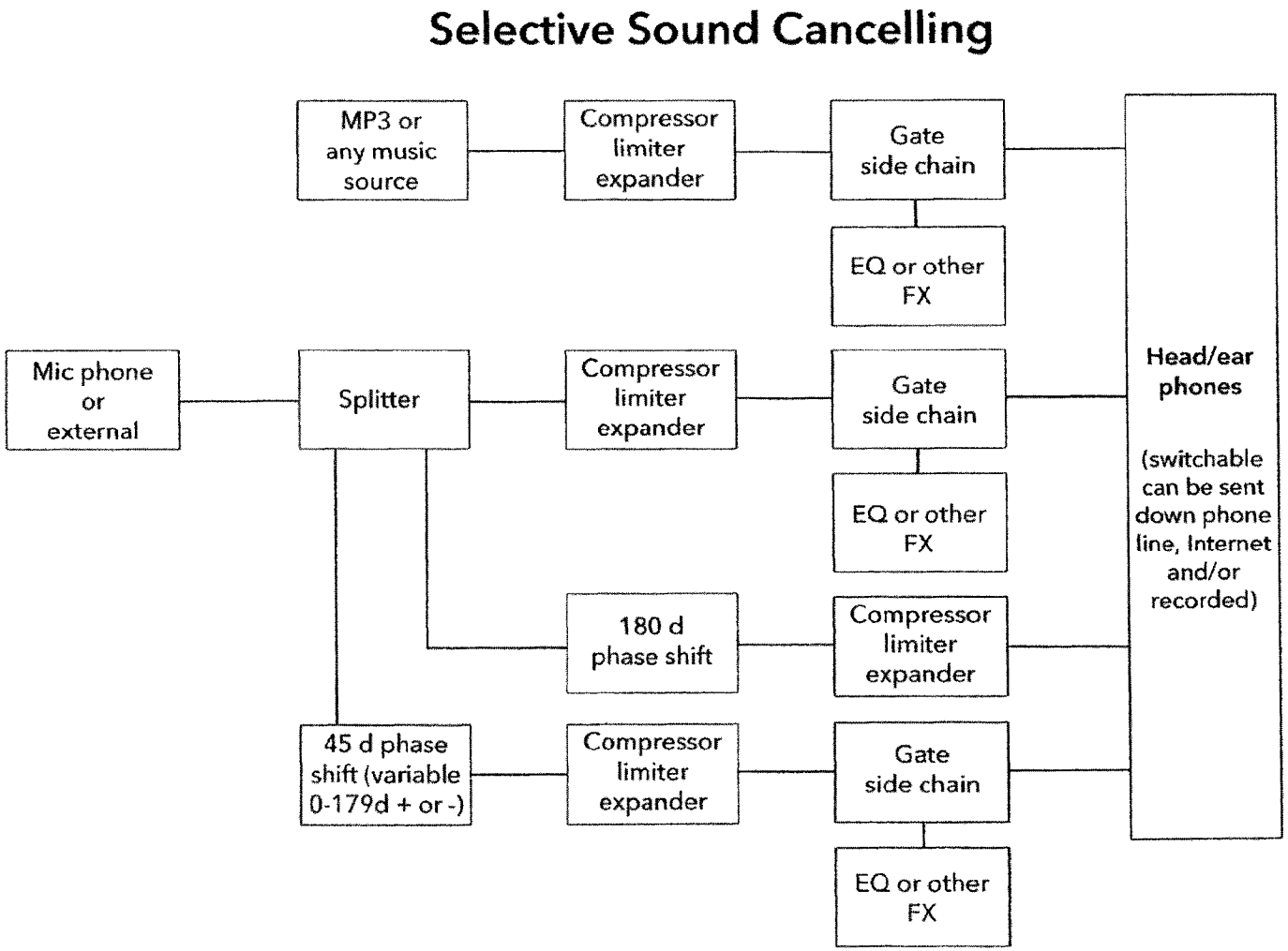
FIG. 1 is schematic drawing of a selective sound cancelling system.

FIG. 1 shows an overall selective sound cancelling system to exemplify application of an embodiment of the invention to a modern music-capable mobile 'phone. This example is intended to explain the features employed to create a selective sound cancelling system and method and it should not be taken as a limitation of how and where the invention may be used. The specific example used is an Apple® iPhone® 'phone, as it is the simplest to describe. The built-in microphone of the mobile 'phone and/or an additional, external microphone can be used. The system may be configured to work with two or more microphones. The system can work with all headsets, including generic ear-bud headphones. However, it works best when used with 'enclosed' ear-or headphones. It should be mentioned that "FX" means "effects".

Figure 2:
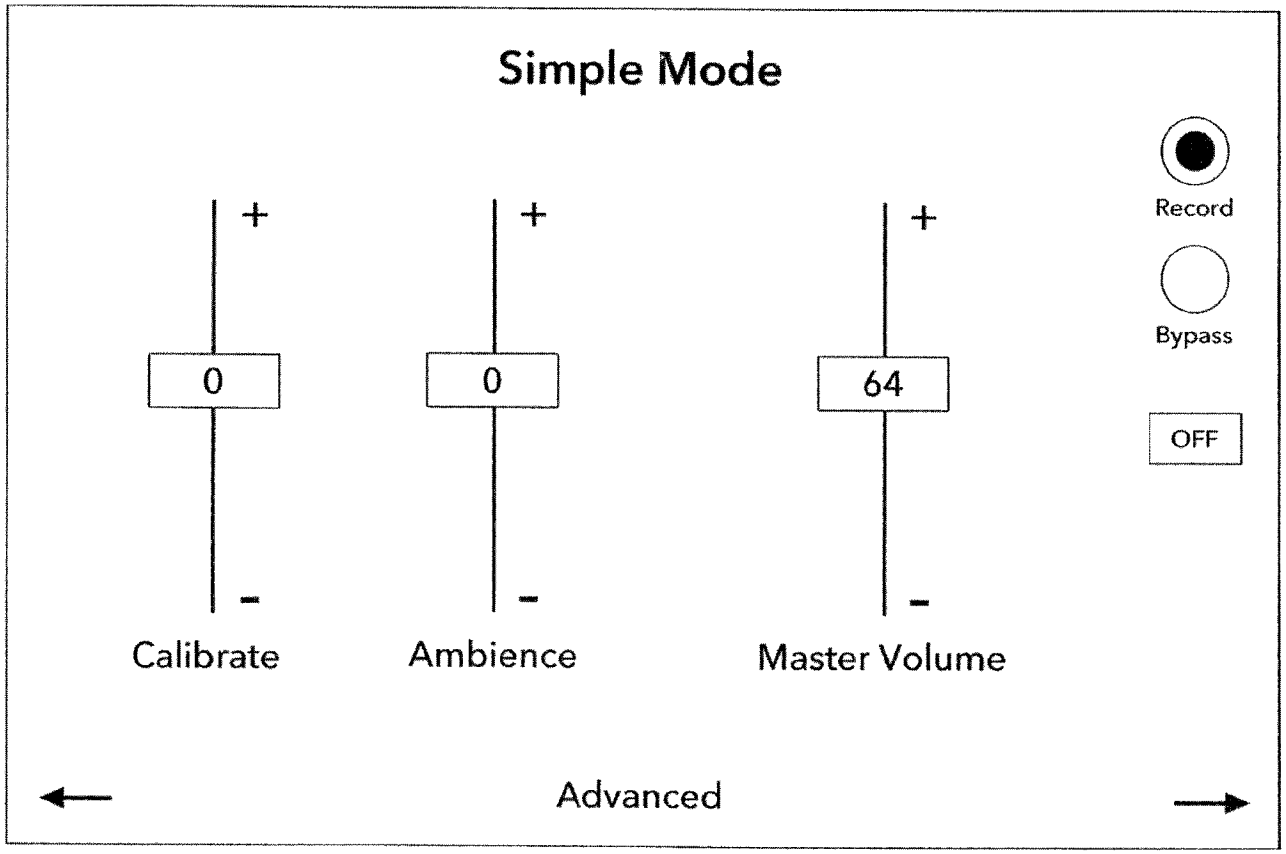
FIG. 2 is a representation of an application interface through which the sound cancelling system can be operated.
Figure 10:
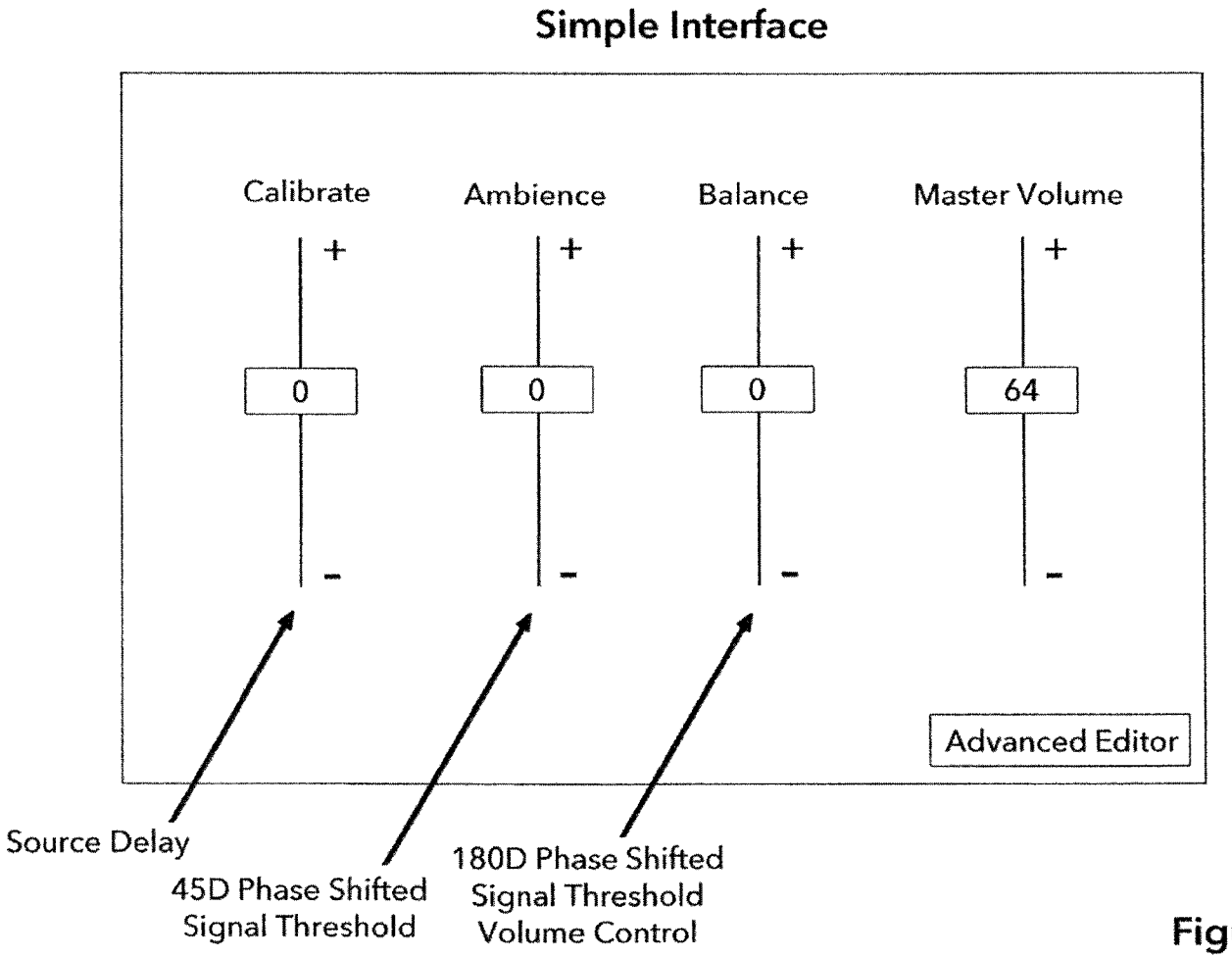
FIGS. 10 and 11 are representations of respective simple application interfaces for operating the system.
Figure 11:
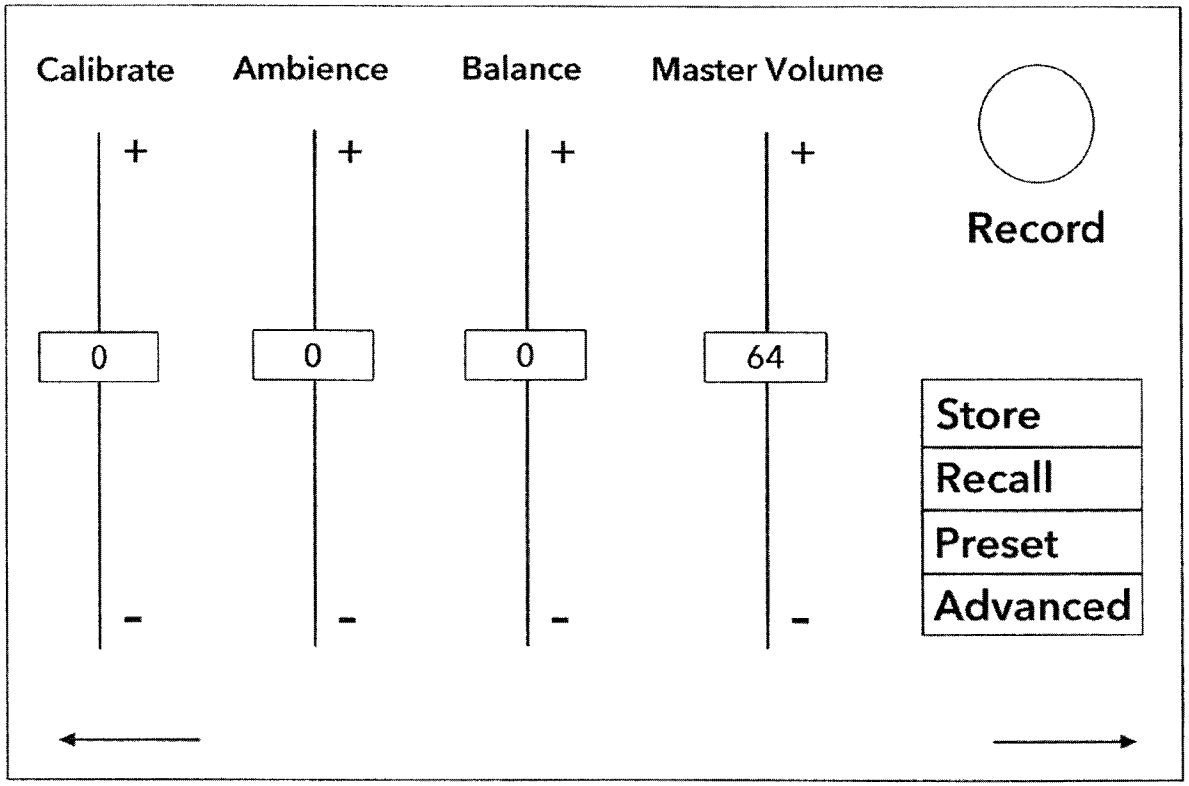

In the iPhone® example, a user may upload a software 'app.' (application) to his iPhone® mobile 'phone to enable the system and provide an application interface which operates the system. The user turns on the 'app.' and is presented with a screen, exemplified in FIG. 2. This Figure represents one simple interface, others being exemplified in FIGS. 10 and 11, which provides limited adjustment of sound cancelling parameters.

In a first mode of operation—in which no audio awareness is required—with the user wearing his ordinary headphones or earphones, the fader labelled 'calibrate' may be adjusted up or down until ambient sound is totally eliminated or vastly reduced. The user need not do anything else if he desires not to hear any ambient sound and he may simply press "play" on his usual music player. Following this type of adjustment only, the user may enjoy the music while hearing minimal or no background sound—which provides the advantage of the user's being able to hear more of the music at lower, safer levels of volume. If the 'phone is used to make a call in this first mode, then the 'app.' pauses until after the user has finished.

As a further possibility, the user may use the system to reduce or eliminate ambient sound without listening to music.

In a second mode, where audio awareness is required, in addition to the steps mentioned above with respect to the first mode, the user moves the fader labelled 'ambience' until he can hear his immediate surroundings at a desired level. The ambience fader allows the user to choose how much of the background sound he hears and allows him to hold a conversation, whilst eliminating or significantly reducing unwanted sound. The effects of both the ambience fader and the calibrate faders allow the user to listen to music, make 'phone calls, and hold live conversations, whilst retaining audio awareness of his immediate surroundings with active selective sound cancelling. In addition to the above, the user may use the 'app.' to 'noise cancel' the receiver sound during a phone call before that sound is transmitted to a recipient caller, which makes conversation for both parties easier and clearer at lower levels of volume—and allows easier and clearer conversations in areas of high background sound—for example when making a call in a windy environment.

In particular, the system allows a user to eliminate, practically all, if not all, background sound, even while listening to music, and still be able to hear things like a police siren, fire alarm, doorbell, or someone talking to him.

Figure 3A:
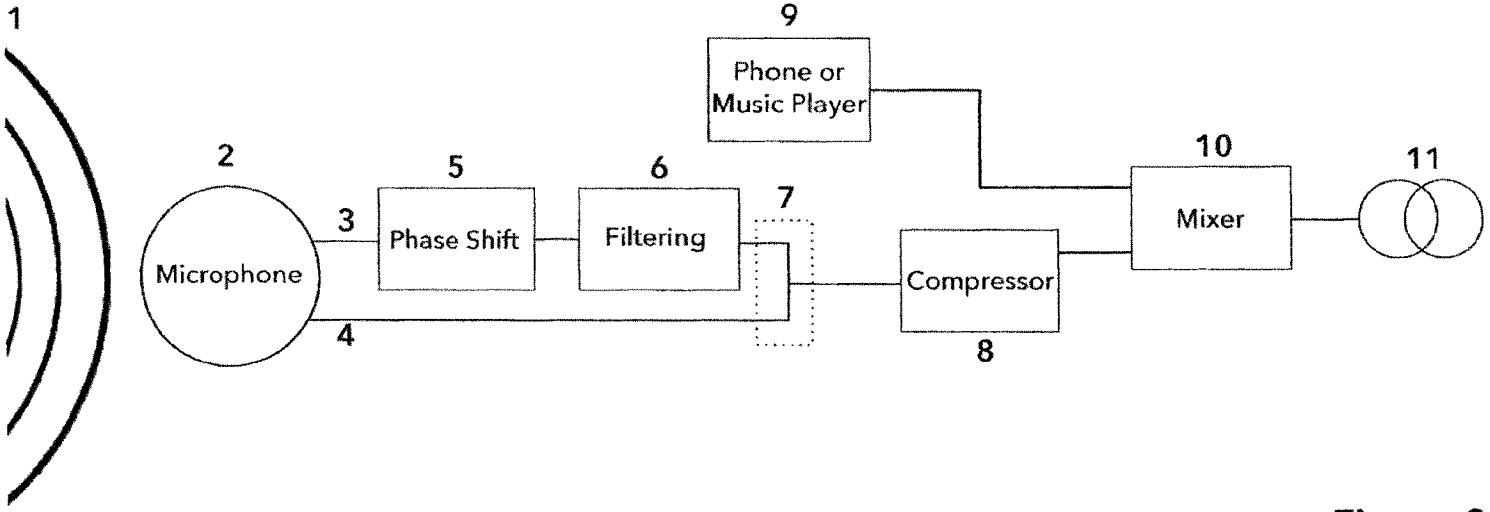
FIG. 3A is schematic drawing of a simplified, selective, sound cancelling system.
Figure 3B:
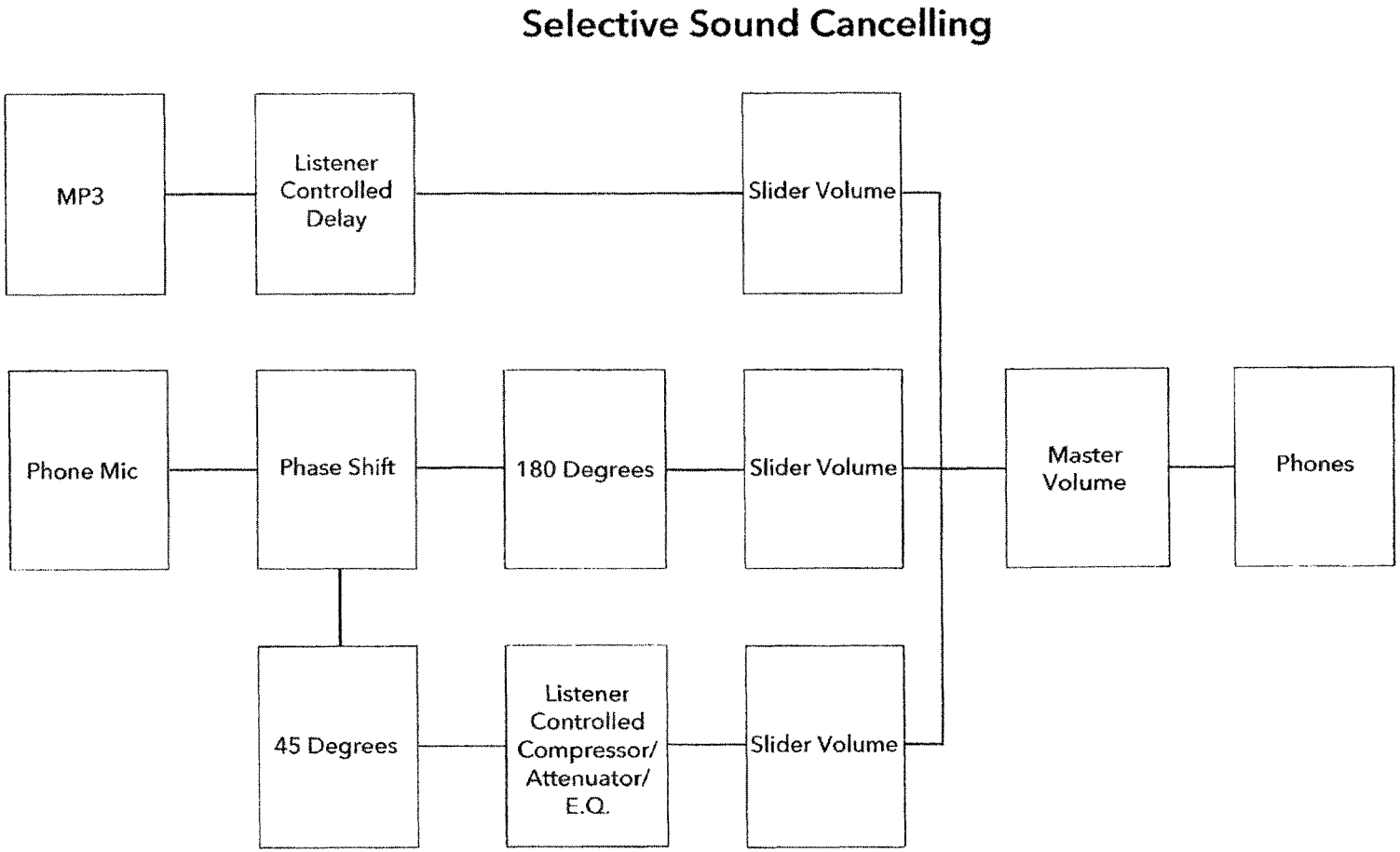
FIG. 3B is a schematic drawing of a less simplified, selective, sound cancelling system.

As exemplified in FIG. 3A, the system can allow a selected portion of the ambient sound received by the microphone 2 to be emitted by the headphones 11 in addition to the desired audio corresponding to the electrical output signal from the desired audio source 9. FIG. 3B shows a less simplified schematic of selective sound cancelling; the system produces the effects described above by taking a signal from the microphone (Mic) of the mobile 'phone and phase-shifting it to produce a cancelling phase-altered signal. Typically this is done by altering the phase of the signal by 180 degrees (further allowing the user to fine-tune the phase shift + or −1 to 5 degrees in each direction). Those skilled in the art will know that, to produce a fully-cancelling phase-altered signal, some leeway is required in the number of degrees of phase shift, as the amount of shift required for correction is affected by numerous external factors, for example wind direction and speed. The phase-altered signal is processed and fed into the headphones, causing the sounds to 'cancel' each other out. However, as mentioned herein, this application of the system and method is only suitable when the user desires to cancel out all background ambience—as described in relation to the first mode of operation. For the second mode of operation, in addition to the above, the system takes a second identical signal from the Mic and produces a partially-cancelling phase-altered signal. Typically this is done by altering the phase of the signal by 45 degrees (although the amount of phase shift can be any partially-cancelling phase shift). This phase-altered signal is further processed to affect individual frequencies, volume, and other audio characteristics using EQ, compression, gates, and/or spectral enhancers, to achieve a desired effect. When this signal is fed into the headphones, no further noise cancelling is provided so that it remains audible. A user may now listen to music on his telephone while retaining a safe level of audio awareness.

Advantageously, this system allows a user to listen to his headphones in a number of useful modes such as: 'total sound cancelling' of all ambient sounds; 'alarm mode', where the user wishes to be alerted by, e.g. a fire alarm, a police siren or even when someone in the user's immediate vicinity talks to him; or 'audio awareness mode', where a user can control and turn down the background ambience he hears—allowing him to retain audio awareness of his immediate surroundings while listening to music or other audio, or when making or receiving a call on his music playing telephone.

Figure 12:
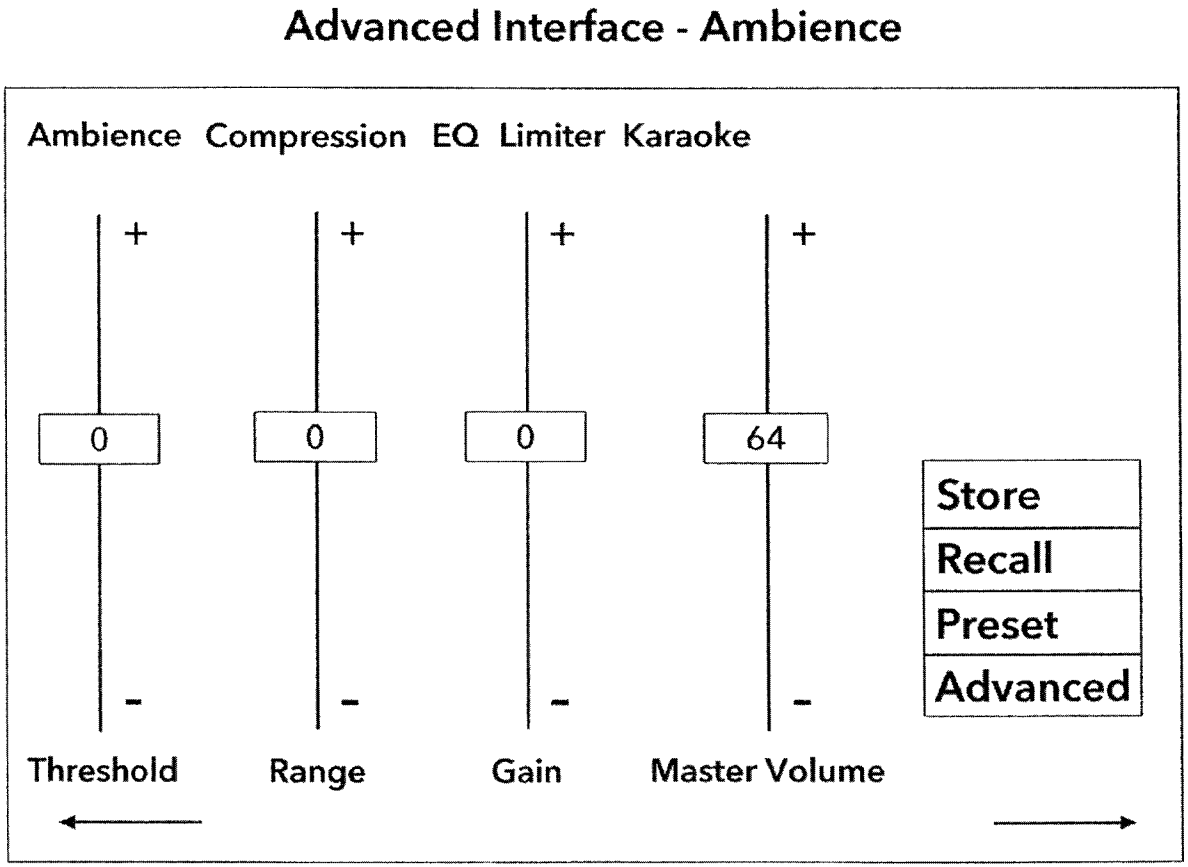
FIGS. 12 to 15 are representations of advanced application interfaces for operating the system, the interfaces being where respectively ambience, compression, EQ and limiter settings can be fine-tuned.
Figure 13:
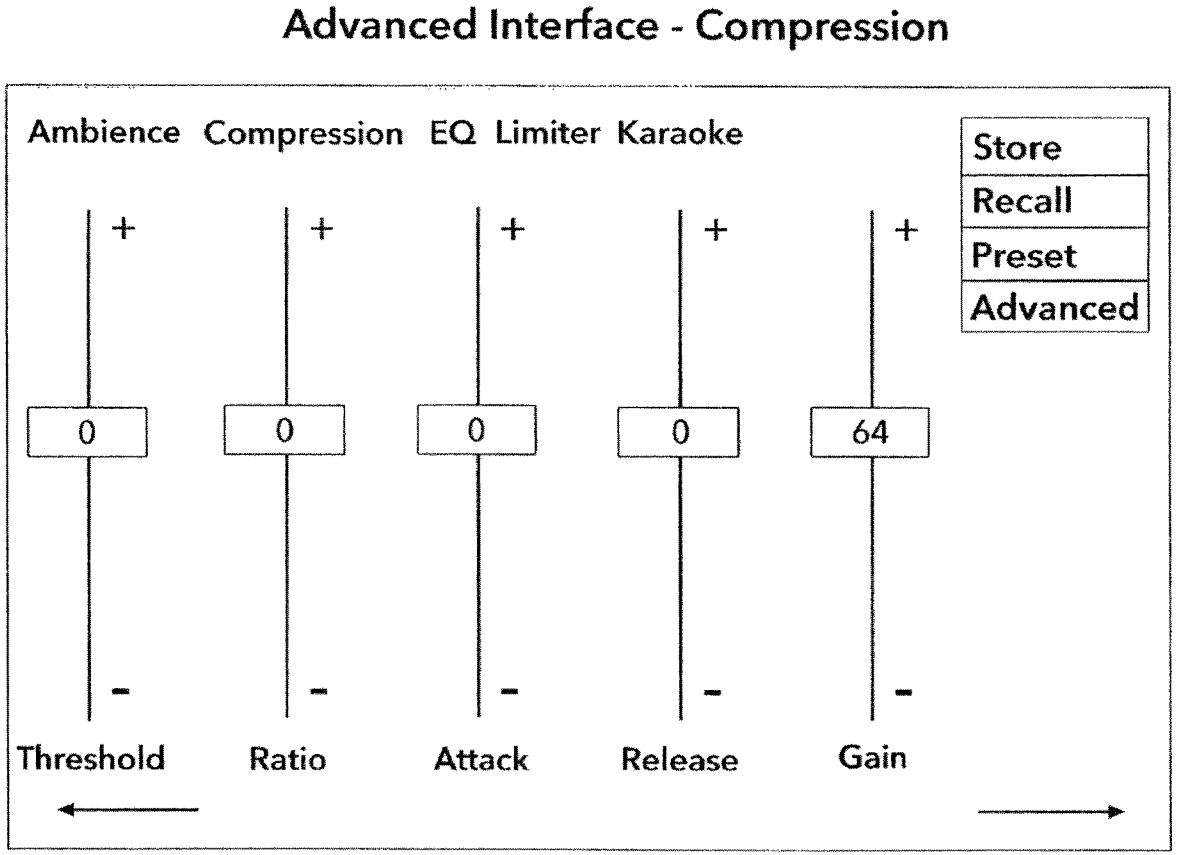
Figure 14:
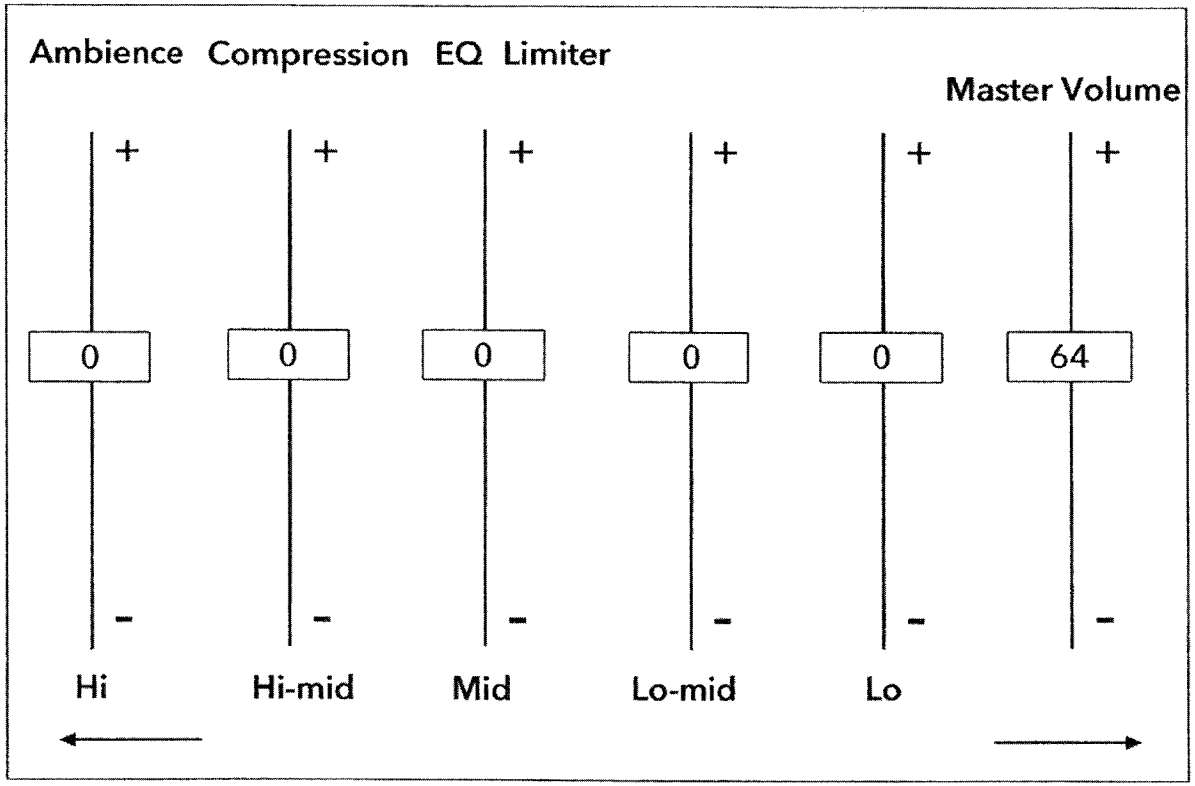
Figure 15:
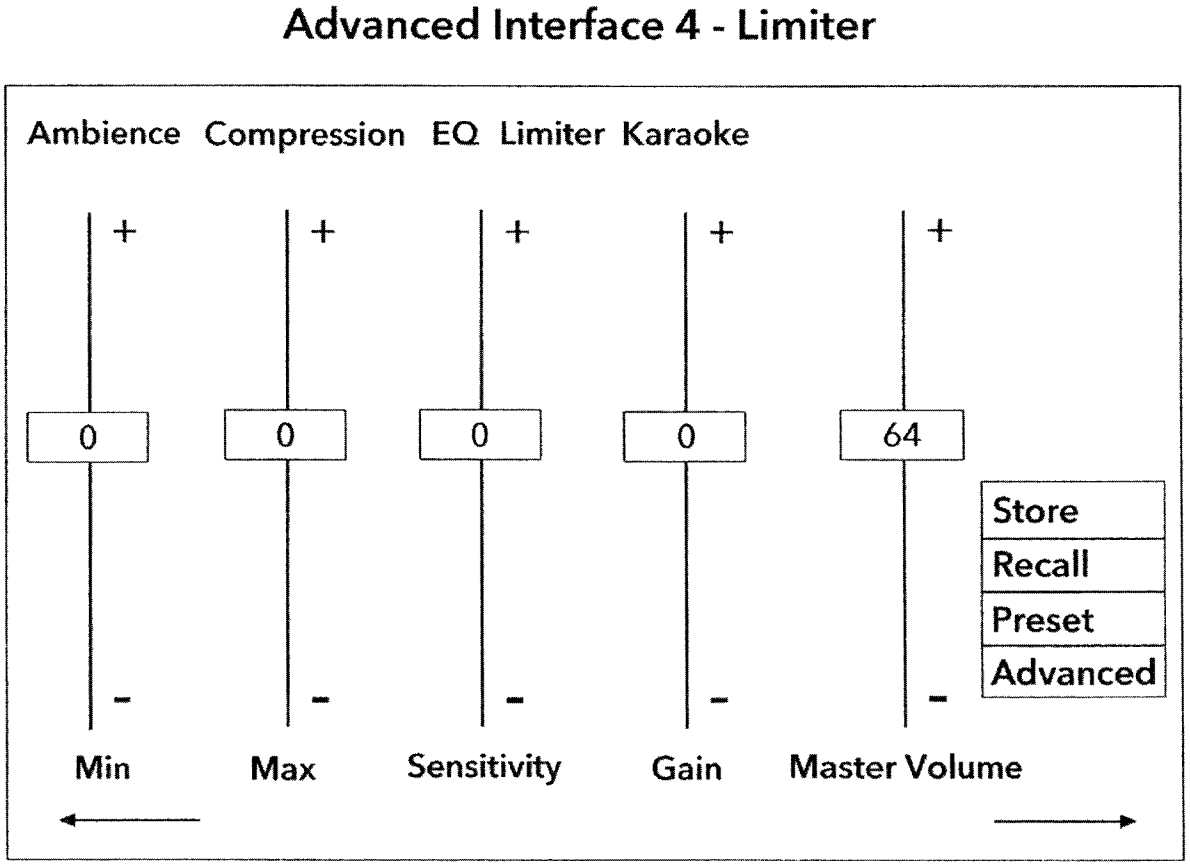

An advanced interface is shown in FIGS. 12 to 15. Through the advanced interface the user has the option to edit key sound-cancelling parameters, allowing him effectively to choose the ambient background sound he wants to hear. For example, a user may want to 'noise cancel' the sound of train tracks whilst being able to hear a message over a train's public address system. A number of other innovative features are accessed via the advanced mode. FIG. 12 shows the range of features that can be accessed through the 'ambience' tab, for example, threshold, range and gain. FIG. 13 shows the range of features accessible through the 'compression' tab, for example, threshold, ratio, attack, release and gain. As to FIG. 14, this shows the features of EQ which may be adjusted through the 'EQ' tab, for example, hi, hi-mid, mid, lo-mid, and lo. A more sophisticated EQ may be used, for example, band filtering with an adjustable Q factor. FIG. 15 shows the range of features that are adjustable through the 'limiter' tab, for example min., max., sensitivity and gain.

Figure 16:
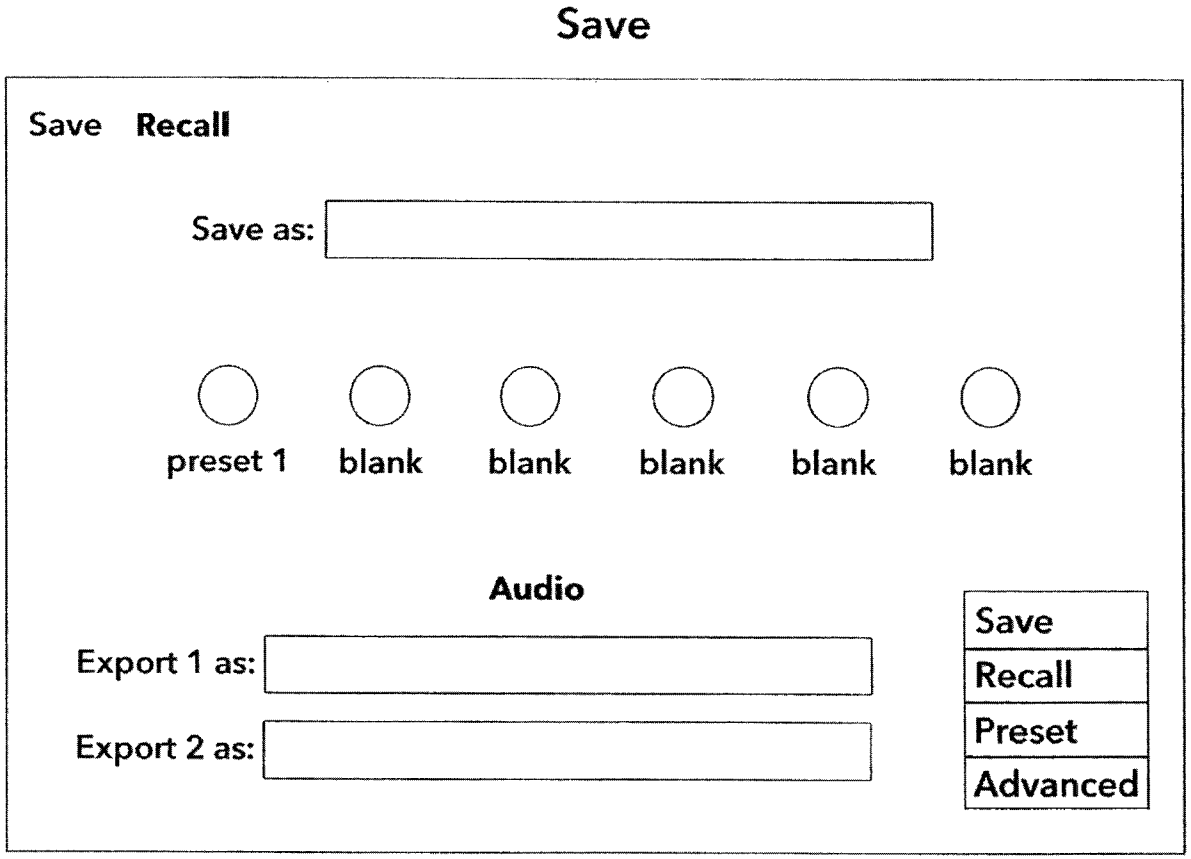
FIGS. 16 and 17 are representations of application interfaces for operating the system and through which settings may be stored and recalled/imported, respectively.
Figure 17:
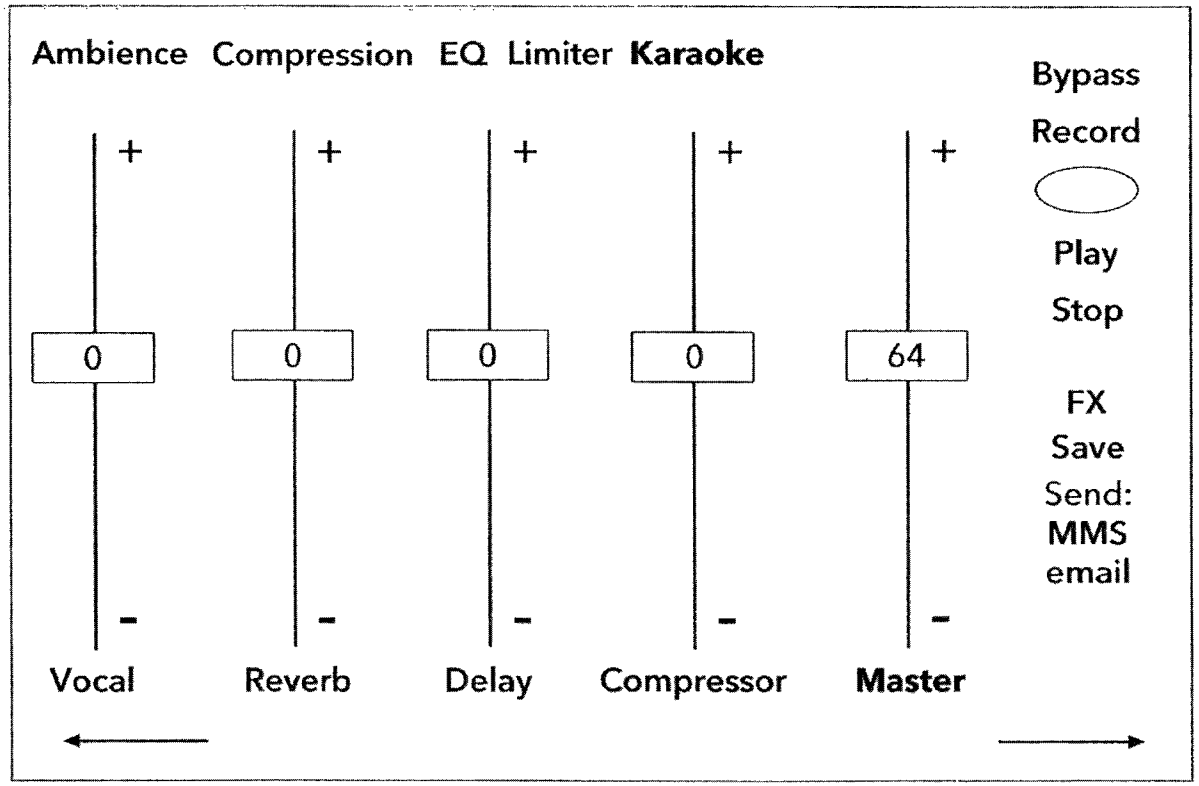

FIGS. 16 and 17 show the interface through which advanced setting may be stored and recalled. A number of blank preset settings are provided for a user to save his own preferred settings. In addition, factory-set presets can be accessed from this interface.

Figure 4:
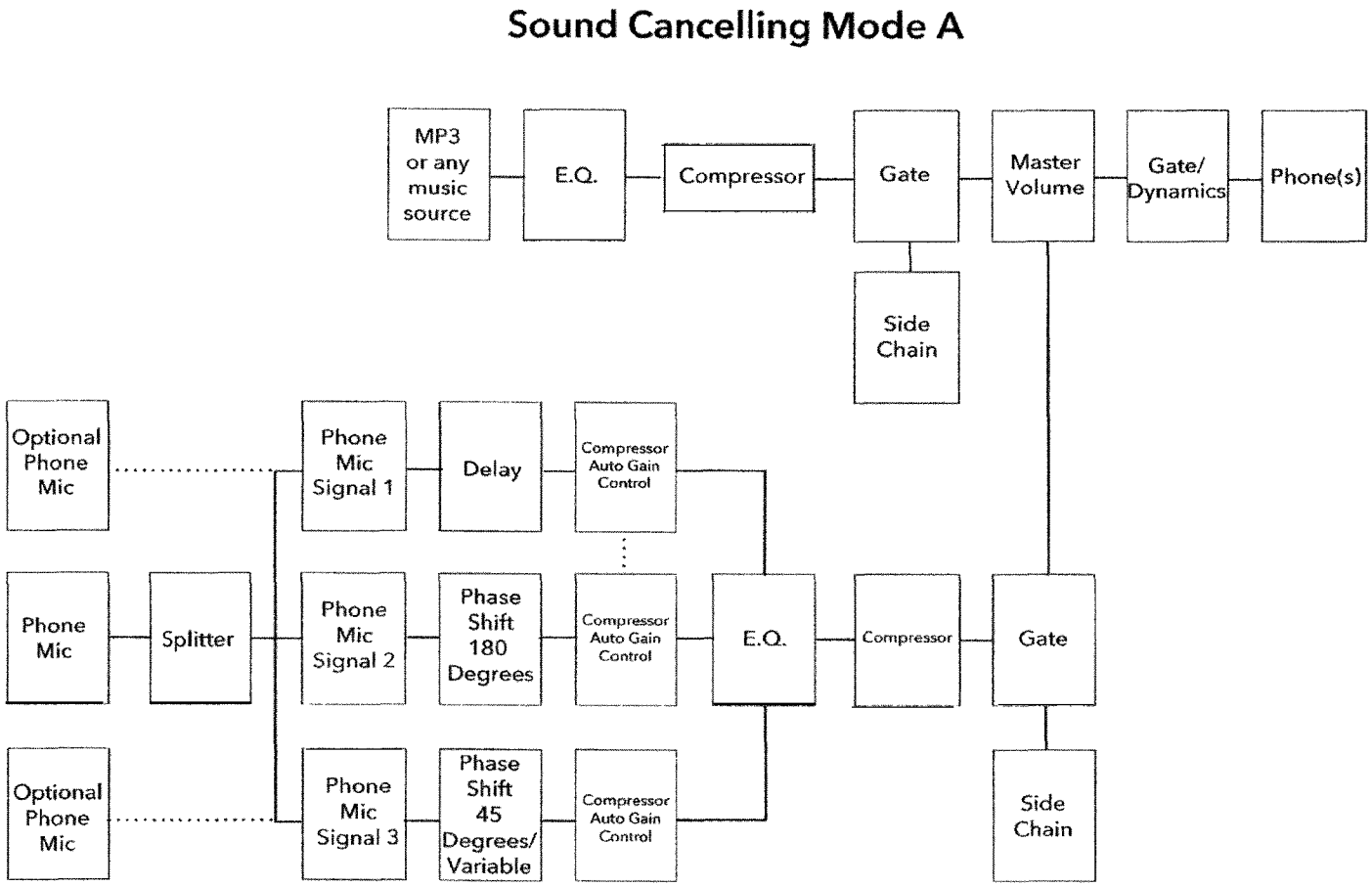
FIG. 4 is a schematic drawing of a sound cancelling system and shows Sound Cancelling Mode A.
Figure 5:
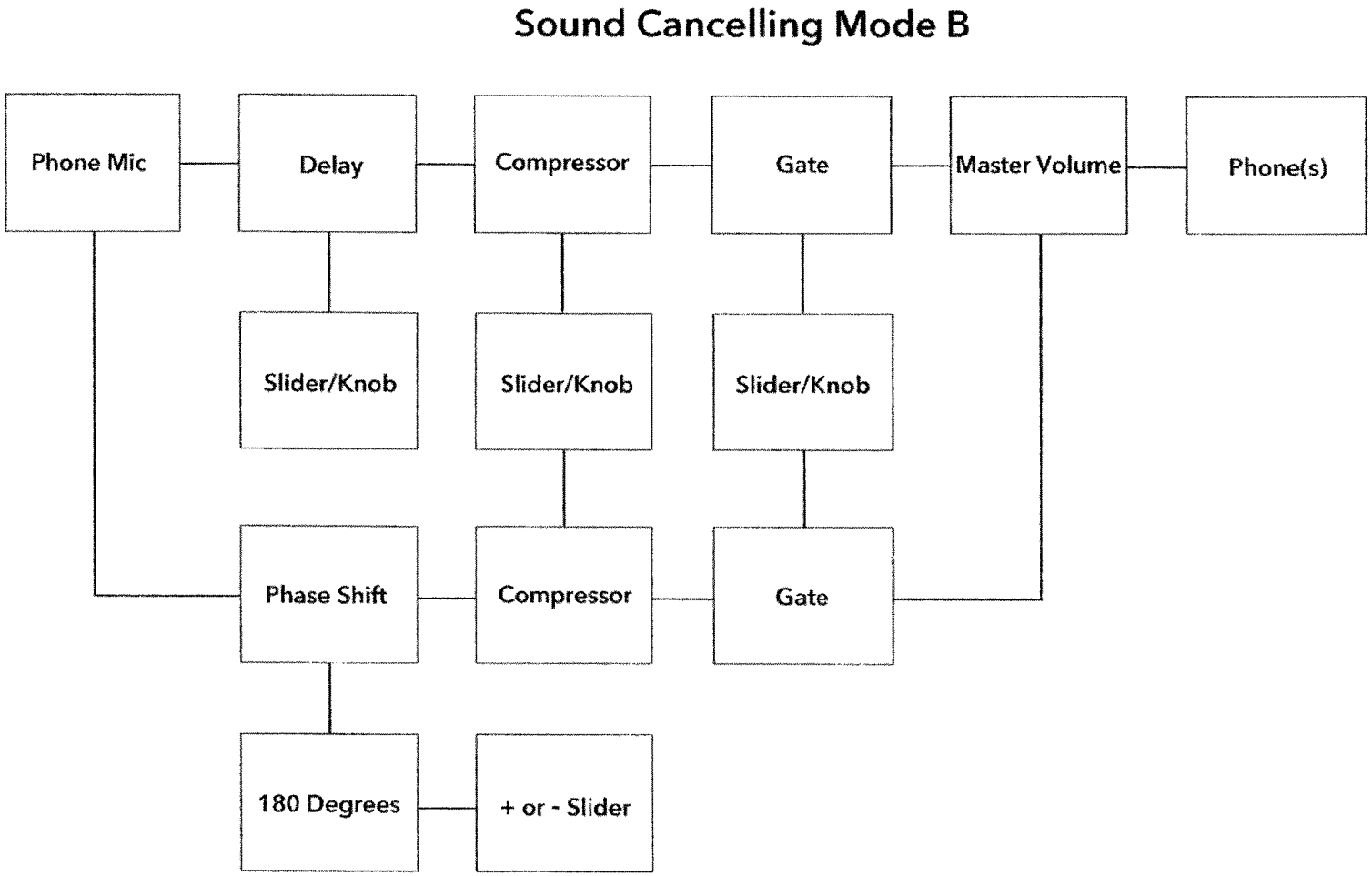
FIG. 5 is a schematic drawing of a sound cancelling system and shows Sound Cancelling Mode B.
Figure 6:
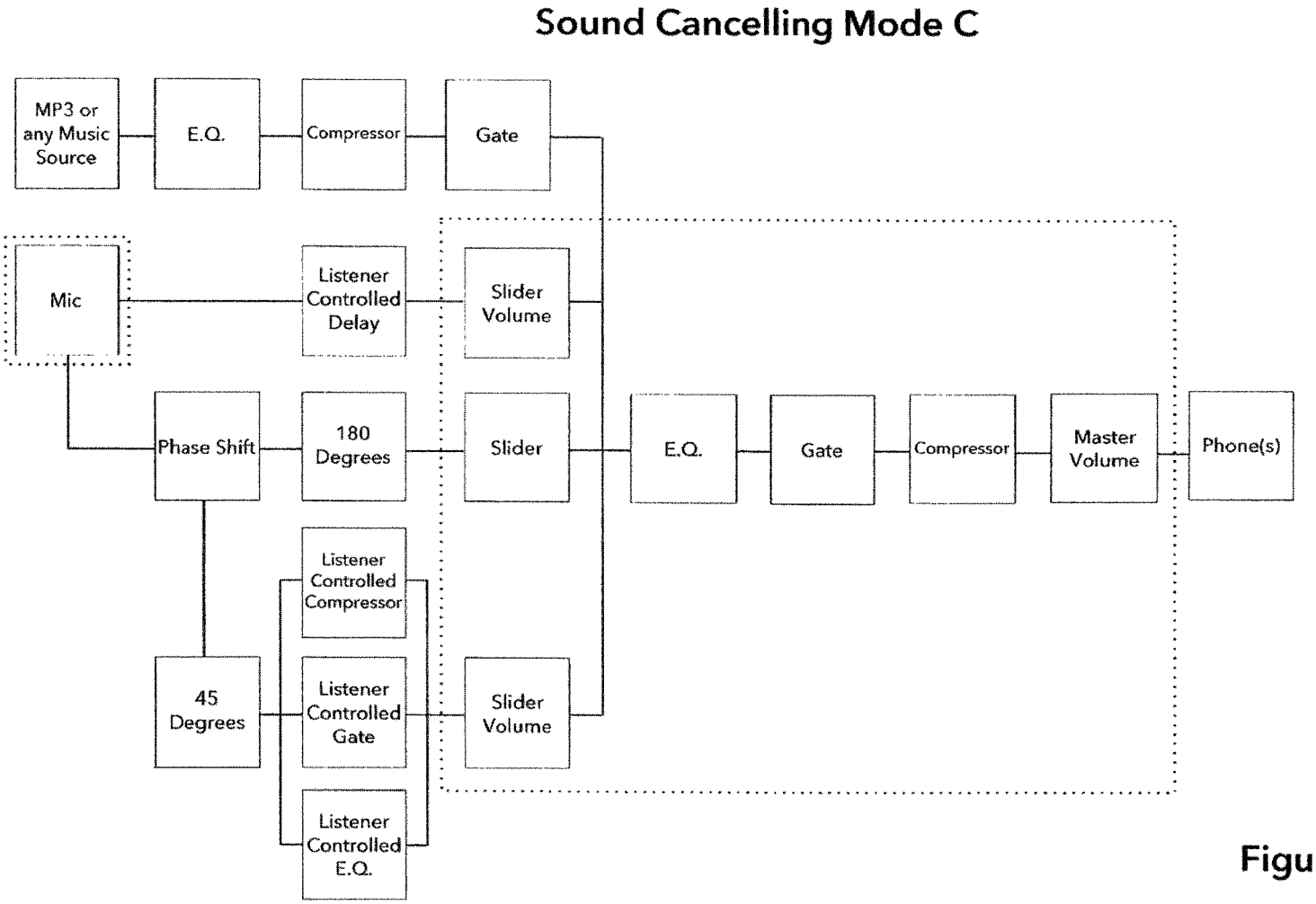
FIG. 6 is a schematic drawing of a sound cancelling system and shows Sound Cancelling Mode C.

FIGS. 4, 5 and 6 show Modes A to C for sound cancelling. Mode A relates to selective sound cancelling and shows one or more optional microphones. Mode B relates to maximum sound cancelling. In Mode C, the features enclosed in dotted lines can either be user-controlled via a software interface (see FIG. 1) or be included in an external controller unit.

An alternative embodiment is shown in FIG. 7, which exemplifies selective sound cancelling on hearing aids. Hearing aid users often find themselves caught in a vicious circle that results in damaging their hearing—it is instinctive for a user to turn up his hearing aid as his hearing deteriorates or when there is a lot of background sound. This can accelerates hearing loss. This embodiment solves this and other associated problems by cancelling out unwanted background ambient sound. This allows the user to hear more easily and at much safer levels of volume—preserving his hearing. In particular, hearing aids can be modified to include the present system. An optional external controller may be added to the hearing aid allowing a user to fine-tune what sound to cancel—to suit personal preference and requirements; in particular, components enclosed by the dotted lines could be incorporated in an external hardware module allowing users to fine tune the system to work according to their needs or preferences. Alternatively, a number of presets can be programmed into the hearing aid to work in various modes, e.g. selectively to reduce unwanted ambient sound such as machinery, motor cars, trains and/or aeroplanes.

Figure 8:
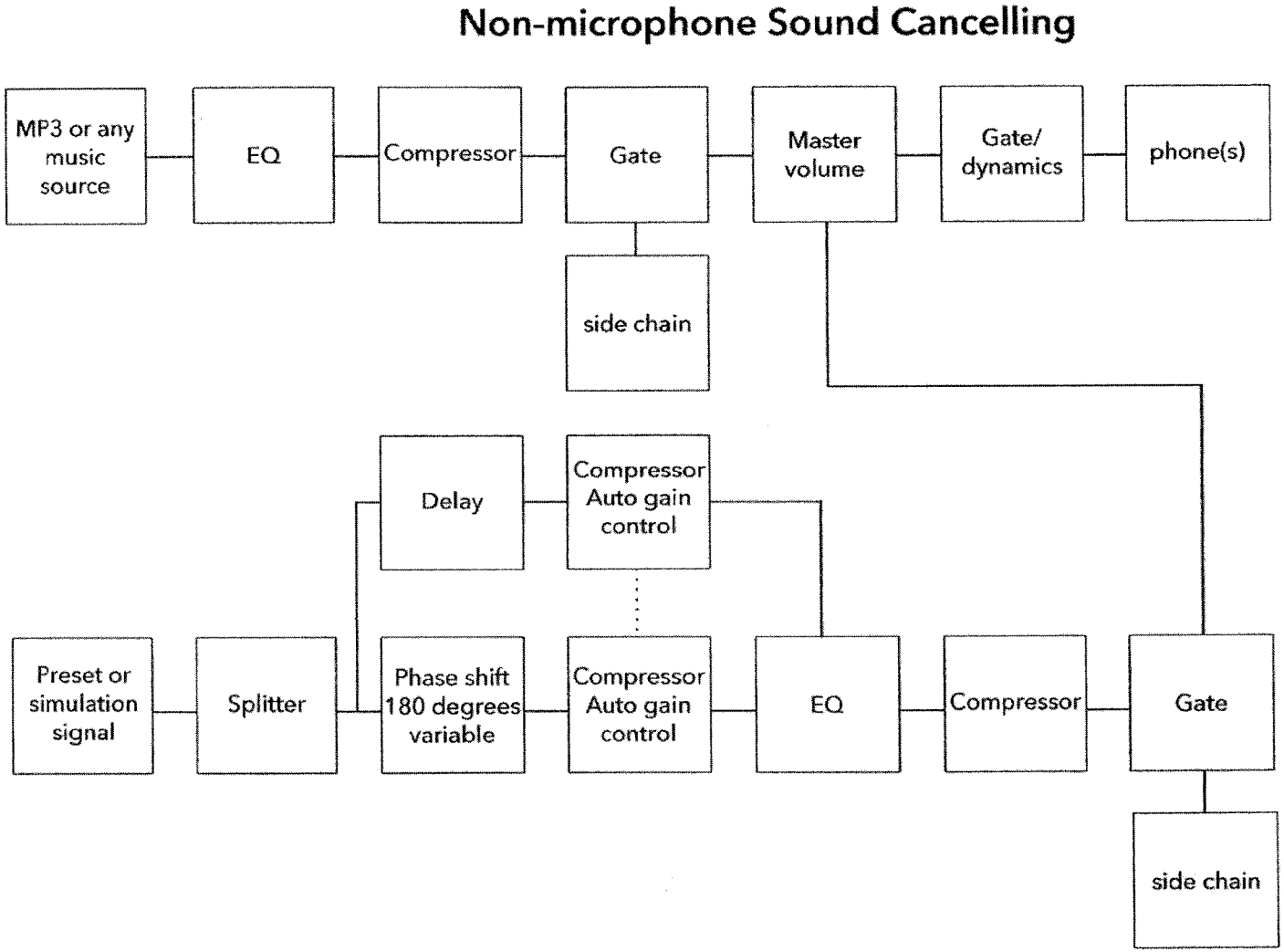
FIG. 8 is a schematic drawing of a sound cancelling system and shows Non-Microphone Sound Cancelling.

FIG. 8 shows a further alternative embodiment which is a non-microphone version. The system may employ representations of common sound factors as presets—in effect allowing non-Mic devices to work with the system and without the use of a microphone, e.g. standard mp3 players. The 'app' for non-Mic platforms may contain a number of presets such as 'airplane mode', where the sound to be cancelled is engine or cabin sounds. A user also has the option of using and creating his own previously recorded sound samples to serve as counter signals for sound cancellation. For example, a user can record ambient sound using a mobile phone, save the file as an MP3 and import it to his MP3 player to be used as the sound source to cancel. In this mode the system allows a user to synthesise the sound he wants to cancel (i.e. not hear). Further to this, the system may employ an external microphone, allowing it to be used on any music player. There are a wide range of headphones that feature a built-in microphone, allowing mp3 hardware and all other audio delivery systems to work with the system.

Figure 9:
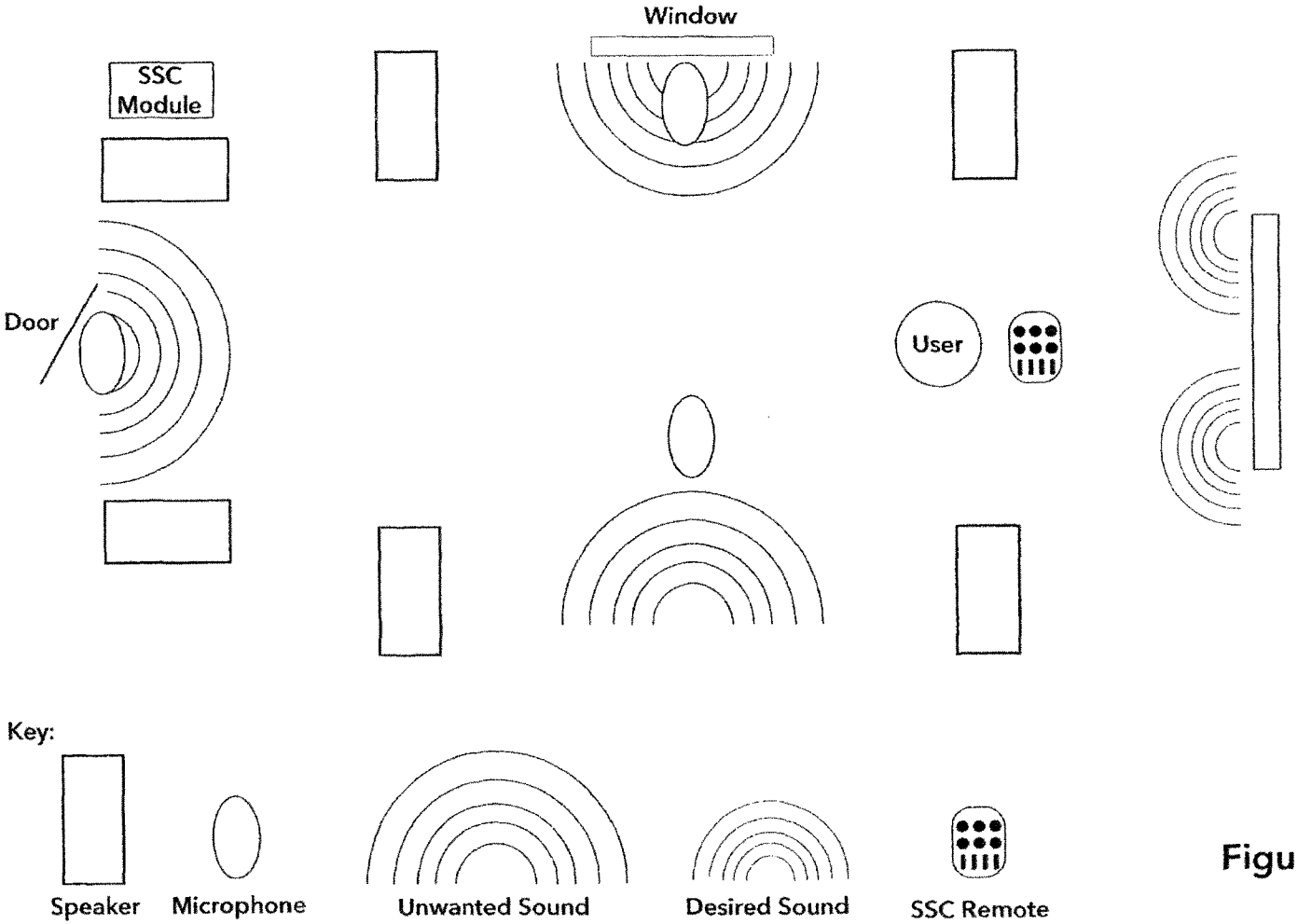
FIG. 9 is a schematic drawing of a sound cancelling system and shows Speaker-Based Selective Sound Cancelling.

A further alternative embodiment is shown in FIG. 9 and is directed towards speaker-based selective sound cancelling. Variations of the system can be used to suit specific applications. For example, a living room may require a 4-microphone configuration, whilst a large hall may require 30 microphones. An audio specialist would need to advise on placement of microphones and loud-speakers, and calibrate the system. This is useful for eliminating or significantly reducing unwanted background sound in rooms, in open-plan offices, in cinemas, concert halls, meeting rooms, and even at open-air events. The actual positioning of the microphones and loud-speakers would be determined after a full acoustic survey by an acoustic specialist who would also advise on the selective sound cancellation configuration and on the equipment required, e.g. the number of microphones and loud-speakers. A living room example, with a television set, three noise-receiving microphones and six noise-cancelling loud-speakers, is shown in FIG. 9. The system illustrated in FIG. 9 allows a user to tweak the remote control until optimal settings are achieved. In more complex situations, such as open plan offices or theatres, calibration would be completed by a trained specialist. In particular, it is noteworthy that a microphone is positioned in front of each source of unwanted sound in FIG. 9. Further, loud-speakers are positioned near the unwanted sound. Therefore, with the loud-speaker emitting a cancelling, phase-altered signal of that unwanted sound, sound-cancelling is achieved. Although not shown, if a door bell were to chime, that sound would not be cancelled—unless desired by the user—and thereby would alert the user.

Figure 18:
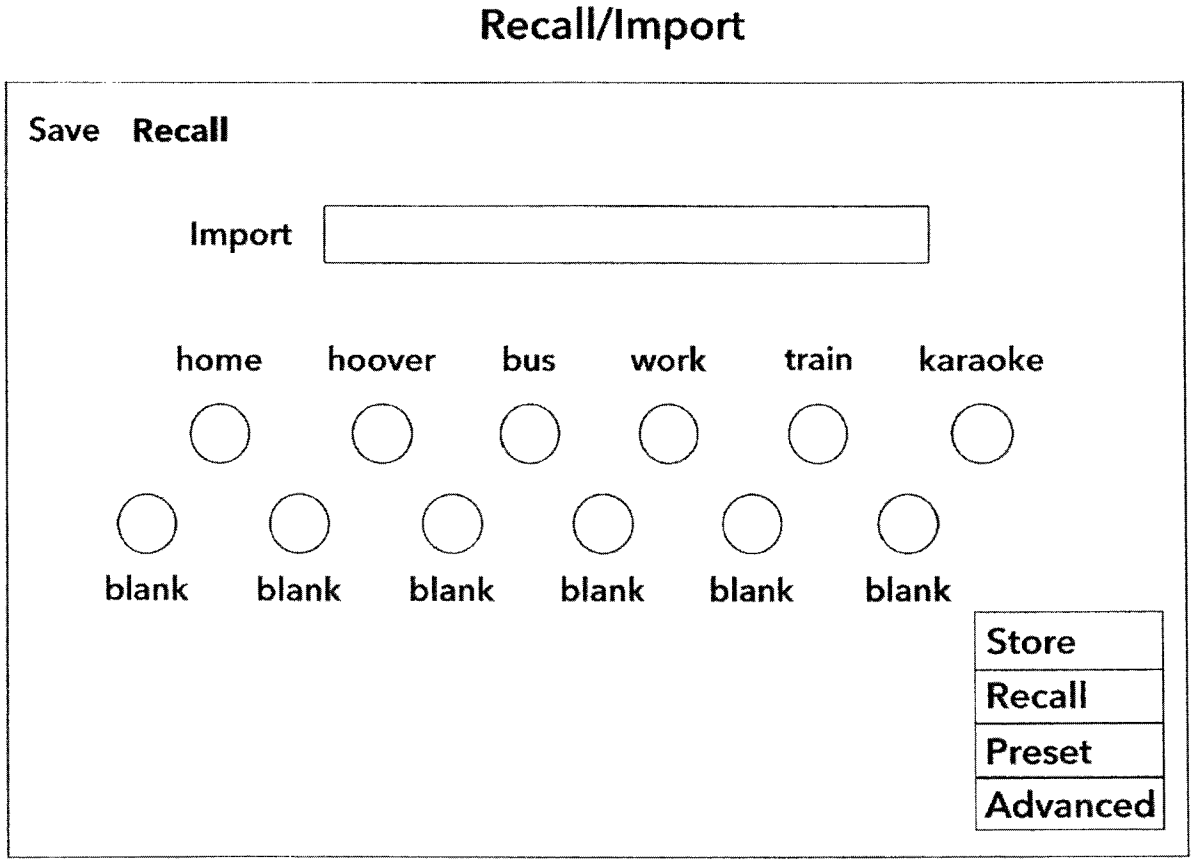
FIG. 18 is a representation of a karaoke interface for operating the system.

FIG. 18 shows a karaoke interface, particularly a multi-track recorder, in which mode a user can record vocals or any instrument such as guitar or drums. The user may adjust features, such as vocal, reverberation, delay and compressor, along with the master volume. Through this interface the user may adjust the sound-cancelling effects produced and save, import, export files/settings together with the normal play, etc. functions.

The following possible additional features of the system are now described in brief detail.

The 'app.' which implements the system can be designed to accept software plug-ins. The definition of a plug-in, as used on this system, is a separate piece of compatible software that can be used in conjunction with the system to add new features. Once a user has installed the 'app.' on his device he can download or otherwise acquire an 'add on' piece of software (plug-in) that is used by the main 'app.' to add or increase functionality. For example, a user can download a voice-changing or reverberation effect plug-in.

The system may feature a recording facility allowing a user to record meetings, messages, memos, or karaoke, with active selective sound cancelling. The recorded file can be played back on any music player and can be exported to any external device, e.g. PC or MP3 player and sent via mms or e-mail [and can be listened to by any caller].

The system may be incorporated into an external hardware unit that can feature a microphone to work on standard mp3 players, hearing aids or other devices that do not have microphones. Other hardware, such as external controllers (wired or wireless) in the form of faders, knobs, or touch screen, may be used to control the sound-cancelling parameters [and other features such as EQ, delay, reverberation etc.].

The system can be configured to make any mobile 'phone or (microphone equipped device) function as a powerful fully-featured hearing aid, with many advantages over traditional hearing aids stemming from selective sound-cancelling functionality.

The system may be configured to make any mobile 'phone or (microphone equipped device) into a powerful fully-featured listening device that can also transmit over the Internet (if the device is Internet-enabled) or as a normal telephone call.

Figure 19:
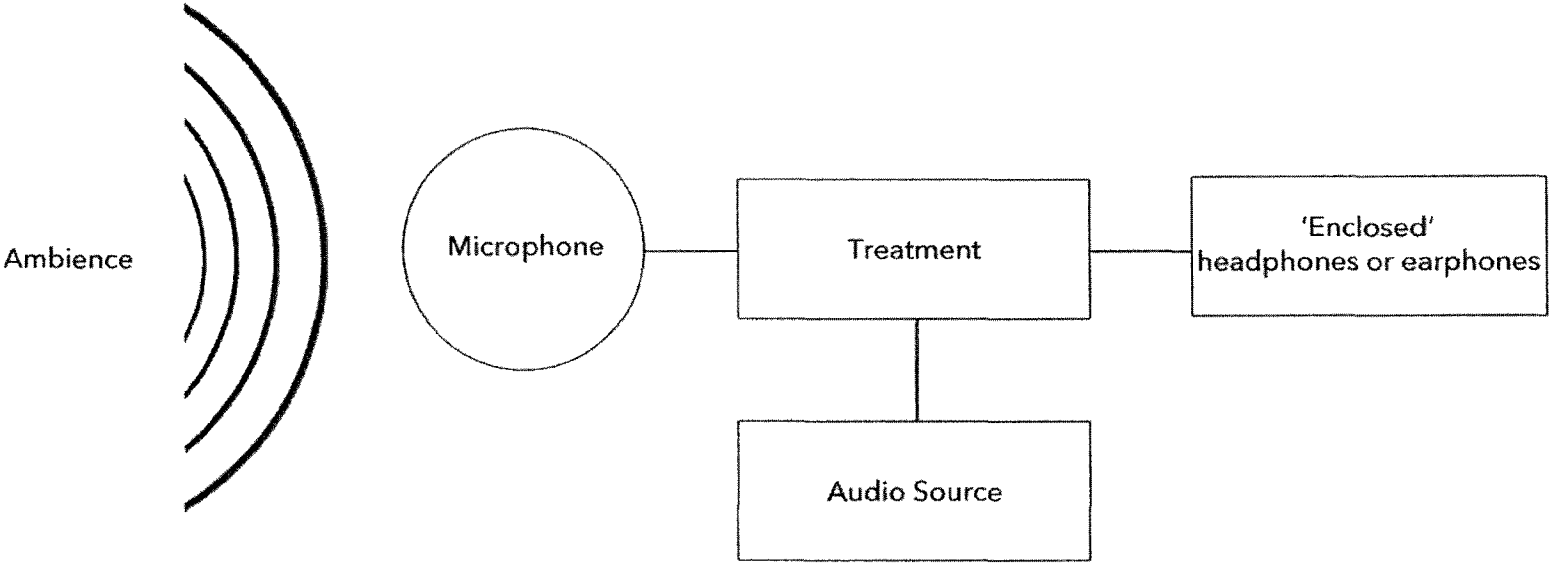
FIG. 19 is a schematic drawing of a basic system applicable particularly to circumstances in which a listener to desired audio is using "enclosed" ear-or headphones.

Referring to FIG. 19, in this basic concept ambient sound is received by a microphone which transmits an electrical output signal representing the ambient sound to a treatment stage which receives another electrical output signal from a source of desired audio, such as music from a digital audio player (MP3). The two signals are combined, (with or without other treatment) and the resulting electrical signal is supplied to "enclosed" ear-or headphones and converted into audio heard by the wearer of the ear-or headphones.

Figure 20:
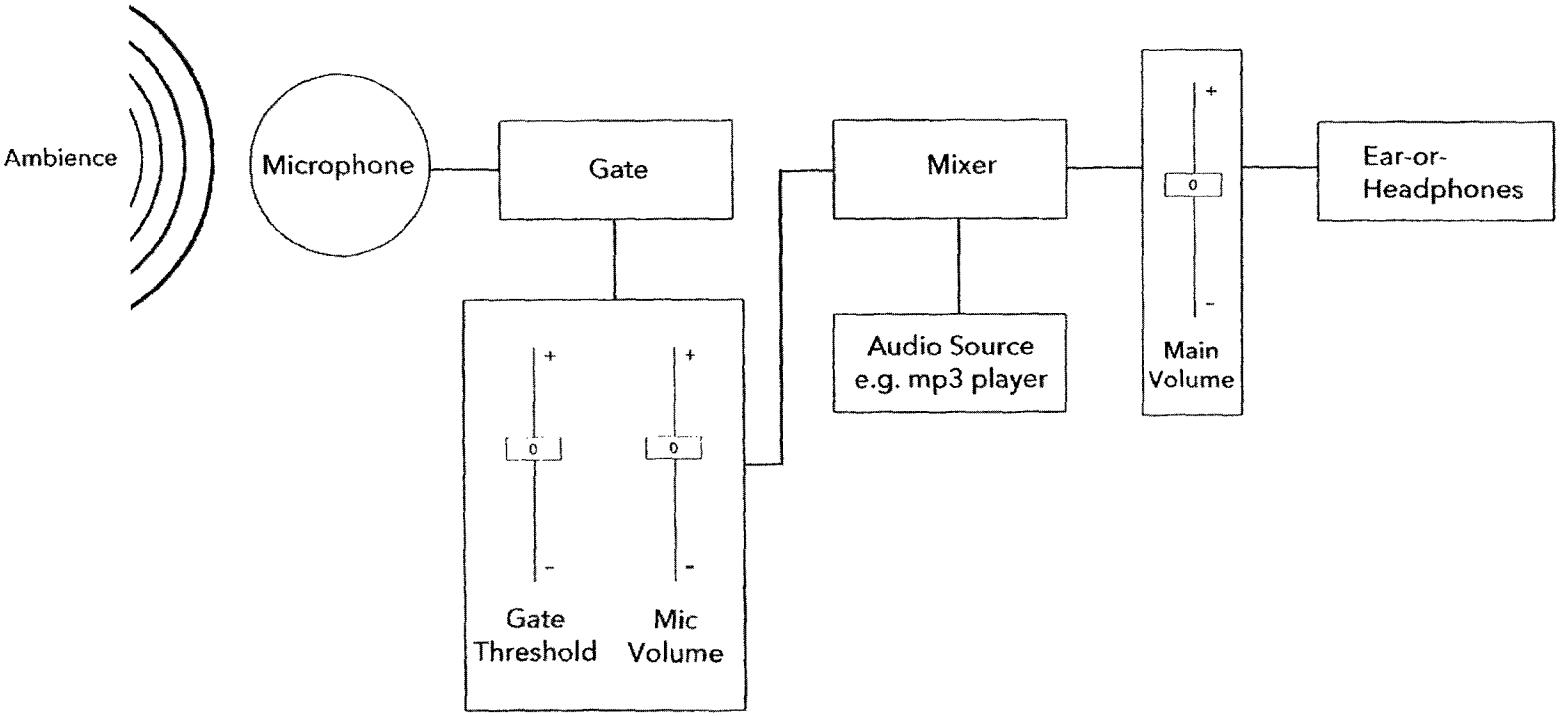
FIG. 20 is a schematic drawing of a relatively simple example of a system within that basic concept.

In the example illustrated in FIG. 20, the electrical output signal from the microphone is gated such that, upon the ambient sound represented by that electrical output signal exceeding a predetermined volume, the gate begins to output an electrical signal to a mixer which also receives the electrical output signal from the source of desired audio (e.g. an MP3 player). The gate threshold is adjustable by the wearer using, for example, a slider. The wearer can also adjust the microphone volume by means of, for example, another slider. The electrical output signal from the mixer is supplied to the ear-or headphones the audio output volume from which is controllable by the user by means of, for example, a slider providing, in effect, a master volume control.

In an alternative example, the gate may have, in addition to the one threshold, an upper threshold, preferably settable independently of the lower threshold—or maybe even set by the manufacturer—to safeguard the wearer against extremely loud sound.

Figure 21:
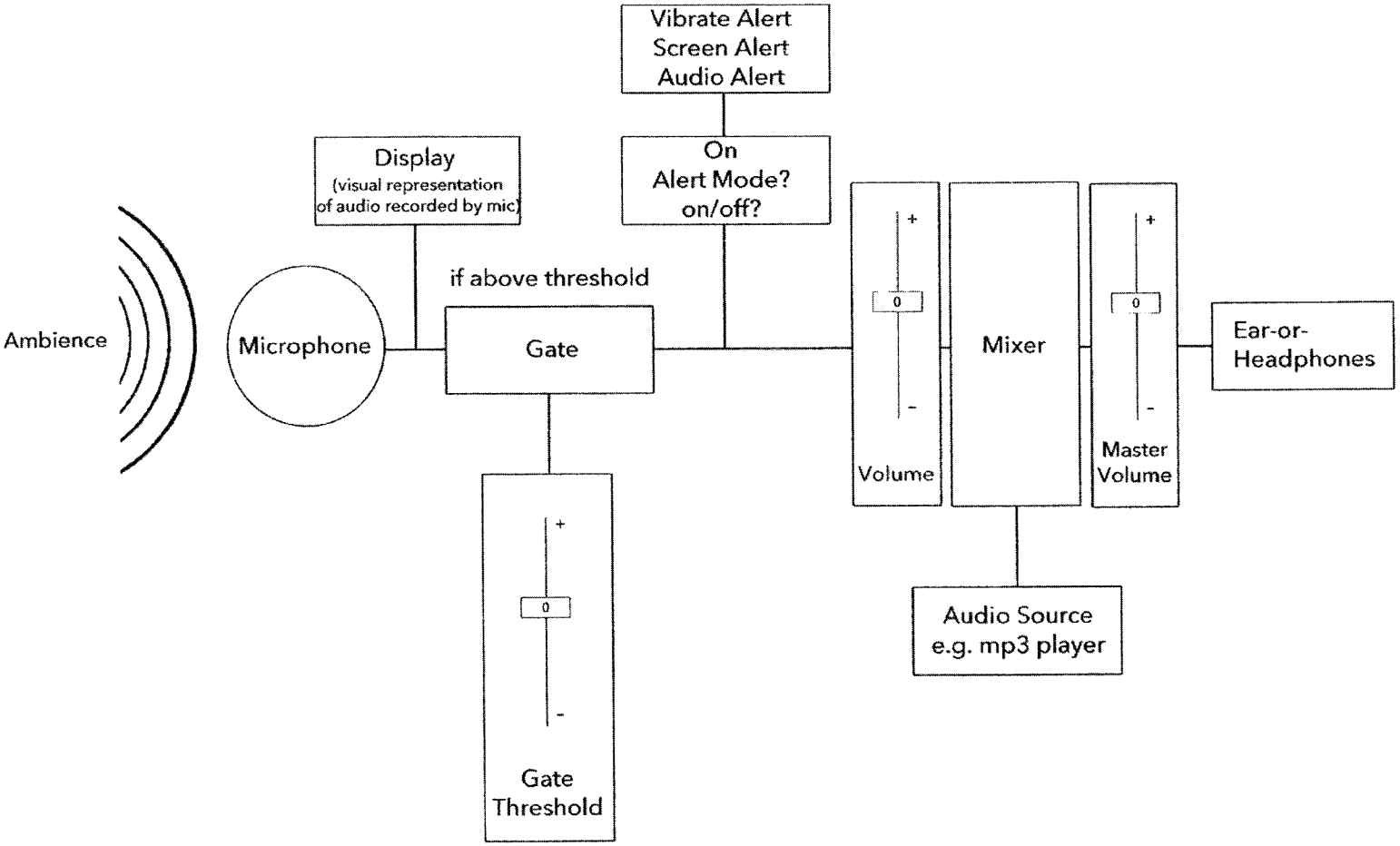
FIG. 21 is a schematic drawing of a less simple example of a system within that basic concept.

In the example shown in FIG. 21, a visual representation of the electrical output signal from the microphone and thus of the ambient sound is displayed. The electrical signal is again gated and the wearer can set the threshold. If the gate threshold is exceeded, the gate output may result in a vibratory, visual or audio alert if the wearer has chosen to switch an alert mode control "ON". The gated ambient sound volume represented by the gated electrical output signal can be adjusted by the wearer and the adjusted signal input to a mixer which receives the electrical output signal from the desired audio source (e.g. an MP3 player). The electrical output signal from the mixer is again fed to the ear-or headphones and a master volume control is again provided.

Figure 22:
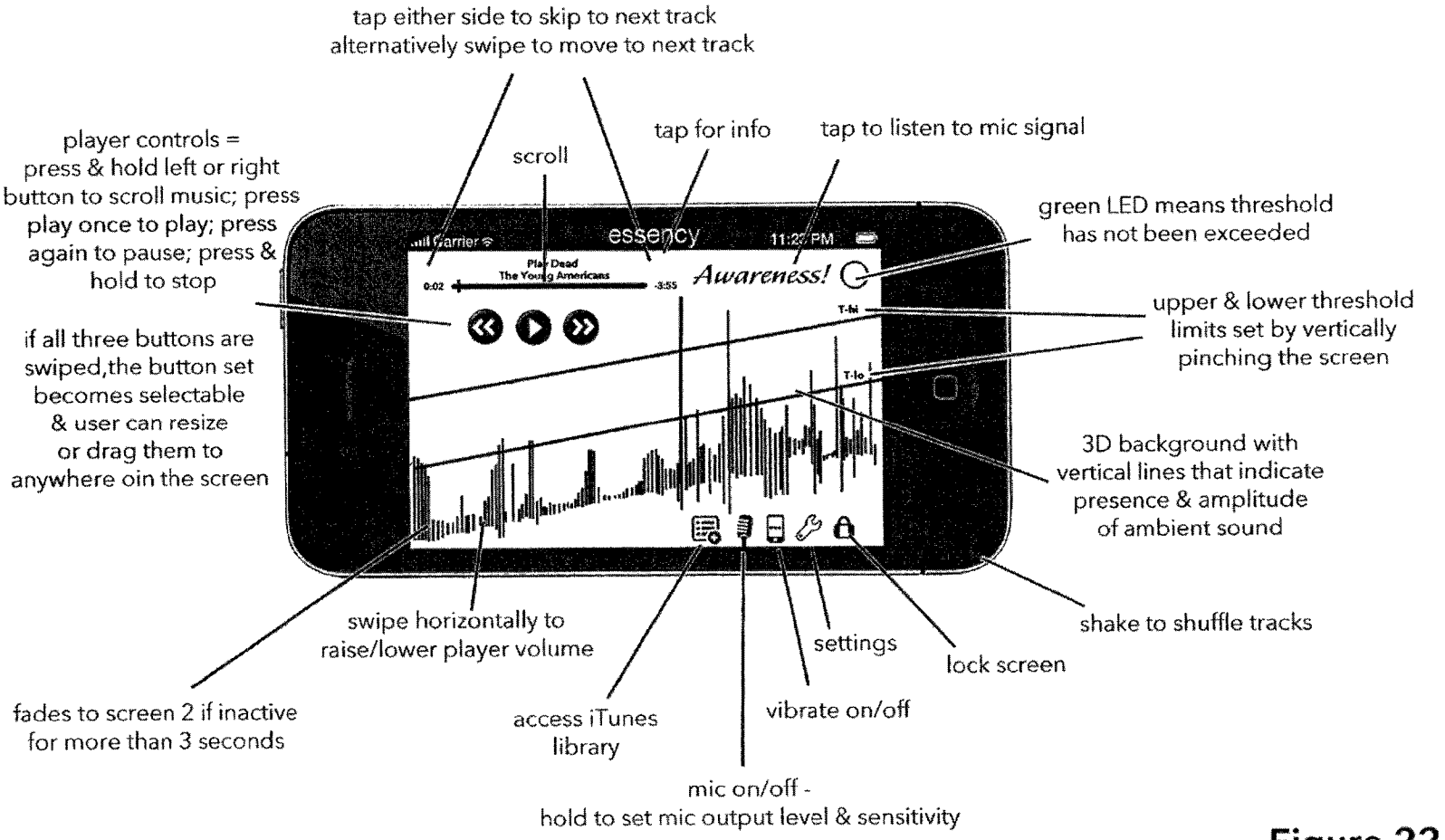
FIG. 22 is a diagram of an "iPhone"® 'phone to which an app. (application) corresponding to the example of FIG. 21 has been uploaded.

FIG. 22 shows an "iPhone®" touch-screen 'phone into which has been uploaded what we call our Awareness!™ app. The various features thereof will now be described progressing in a continuous loop around the 'phone from the top left-hand corner thereof. Tapping the left-hand end of the track scroll switches to the next previous track whilst tapping to the right-hand end thereof switches to the next following track. Alternatively, swiping left to right or right to left between those ends switches to the next previous or next following track. Tapping at the "essency"™ supplies help and other information. Tapping at "Awareness!"™ overrides the desired audio source and leaves simply the output derived from the ambient sound. If the LED (light emitting diode) representation is green, this means that the gate threshold has not been exceeded. If it turns red, this means that the threshold has been exceeded. In the event that, as is the case with this app. example being described, there are upper and lower gating thresholds, these may be set, as indicated by the lines "T-hi" and "T-lo", by carrying out a vertical pinching action on the screen. Shown on the screen is a 3D background with vertical lines which indicate presence and amplitude of ambient sound. The 'phone can be shaken to cause shuffling of the tracks in a random manner. The screen can be locked. Various settings, such as those for the gating threshold and the volumes can be set through sliders which are displayable upon the screen. The vibratory alert can be turned on or off. The microphone can be switched on or off by tapping or the finger can be held down to set the microphone output level and sensitivity. The iTunes library can be accessed. The screen can be swiped horizontally to raise or lower the player volume. Shown is screen 1 of the app. If it is inactivated for more than three seconds, the various controls disappear from the screen leaving only the 3D background, which is screen 2. With the player controls shown, pressing and holding the left or right button scrolls the music. Pressing the central button can produce "play", pressing it again produces "pause" and pressing and holding it returns the track to the beginning. If all three buttons are swiped, their positioning on the screen and their sizes become selectable, so that the user can resize them or drag them individually to anywhere on the screen.

Figure 23:
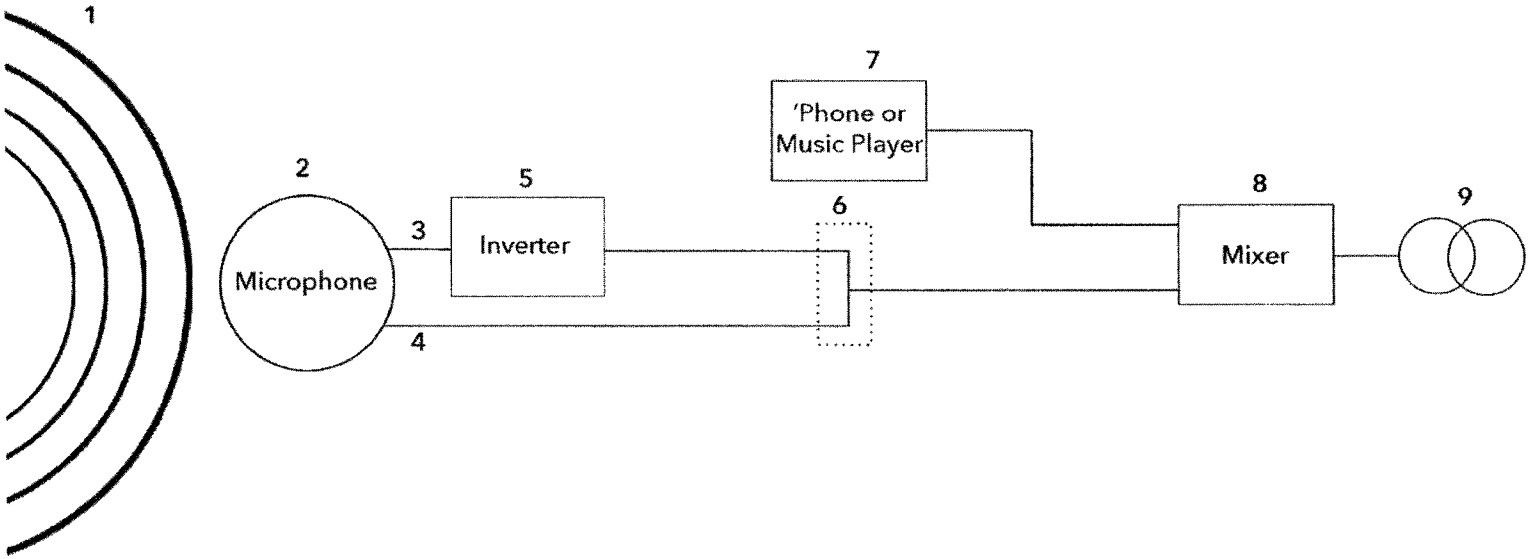
FIG. 23 is a schematic drawing of a simple system applicable particularly to circumstances in which a listener to desired audio using "enclosed" ear-or headphones wishes to exclude as much as feasible of ambient sound.

Referring to FIG. 23, the inversion 5, as regards both amplitude and frequency of the electrical output signal 3 from the microphone 2, means that no ambient sound is mixed in at 8, although of course that does not prevent a minor proportion of the ambient sound reaching the ears of the listener in other ways.

While the various embodiments of the invention have generally been described as treatments relating to the volumes of sound heard by the hearer, the invention is applicable also to treatment of frequencies of such sounds, or to both frequencies and volumes of such sounds.

The invention claimed is:

1. A method of enabling a hearer to hear desired sound while also being able to be aware of ambient sound, comprising providing a first non-sound signal representative of said desired sound, deriving a second non-sound signal representative of said ambient sound without phase shift, combining the first and second non-sound signals in providing a combined non-sound signal, converting said combined non-sound signal into sound, and further comprising providing, for said second non-sound signal, a single threshold representative of a single threshold, for the volume and/or frequency of said ambient sound, or providing for said second non-sound signal, both of a lower threshold and an upper threshold representative of a single threshold, representative of a lower threshold and an upper threshold for the volume and/or frequency of said ambient sound, and providing, by phase-shifting, a third non-sound signal representative of a partially cancelling, ambient sound signal, and combining the first, second and third non-sound signals in providing said combined signal.

2. A method according to claim 1, and further comprising variably adjusting said single threshold, or said lower threshold and/or said upper threshold for said second non-sound signal.

3. A method according to claim 1, and further comprising emitting an alert upon exceeding of said single threshold, or of said lower threshold and/or said upper threshold for said second non-sound signal.

4. A method according to claim 1, and further comprising variably adjusting said second non-sound signal to represent adjustment of the volume and/or frequency of said ambient sound.

5. A method according to claim 1 and further comprising providing a fourth non-sound signal representative of a fully cancelling ambient sound signal and combining the first, second, third and fourth non-sound signals in providing said combined signal.

6. A method according to claim 1, and in the form of selective sound cancellation of the ambient sound giving differentiation between wanted and unwanted sounds in the ambient sound.

7. A method according to claim 6, wherein said third non-sound signal has been preset before said providing thereof.

8. A method according to claim 7, wherein a user selects which sound to cancel by choosing the preset non-sound signal from among a range of differing, preset non-sound signals.

9. A method according to claim 8, wherein the preset non-sound signal is synthesizable.

10. A method according to claim 6, wherein a user selects which sound to cancel by varying one or more sound-cancelling parameters.

11. A method according to claim 10, wherein the one or more sound-cancelling parameters are:

amount of phase shift;
time delay;
individual frequencies;
volume;
equaliser (hi, hi-mid, mid, lo-mid, and/or lo);
compression;
gating;
spectral enhancement;
threshold;
range;
gain;
ratio;
attack;
release;
minimum;
maximum;
sensitivity,
vocal, or
reverberation or any combination thereof.

12. A method according to claim 1, wherein the sound into which said combined non-sound signal is converted is transmitted to a listening person in a space and through air in said space and containing said person.

13. A system for enabling a hearer to hear desired sound while also being able to be aware of ambient sound, comprising a first outputting device adapted to output a first non-sound signal representative of said desired sound, a second outputting device adapted to output a second non-sound signal representative of said ambient sound without phase shift, a third inputting arrangement adapted to provide, by phase-shifting, a third non-sound signal representative of a partially cancelling, ambient sound signal, a combining arrangement adapted to combine the first, second and third non-sound signals to provide a combined non-sound signal, and a converting device adapted to emit sound converted from said combined non-sound signal, wherein said second outputting device is adapted to provide a single threshold or both of a lower threshold and an upper threshold for said second non-sound signal.

14. A system according to claim 13, wherein said second outputting device is variably adjustable to adjust variably said single threshold, or said lower threshold and/or said upper threshold.

15. A system according to claim 13, and further comprising an alerting device able to communicate with said second outputting device to alert to exceeding of said single threshold, or of said lower first threshold and/or said upper threshold.

16. A system according to claim 13, wherein said second outputting device is variably adjustable to adjust variably said second non-sound signal'.

17. A method of enabling a hearer to hear desired sound while also being able to be aware of ambient sound, comprising: providing a first non-sound signal representative of said desired sound, deriving a second non-sound signal representative of said ambient sound without phase shift, combining the first and second non-sound signals in providing a combined non-sound signal, converting the combined non-sound signal into sound, and further comprising variably adjusting said second non-sound signal to represent variable adjustment of the frequency of said ambient sound, and providing, by phase-shifting, a third non-sound signal representative of a partially cancelling, ambient sound signal, and combining the first, second and third non-sound signals in providing said combined signal.

18. A method according to claim 17, wherein said adjusting is automatic.

19. A method according to claim 17, wherein the sound into which said combined non-sound signal is converted is transmitted to a listening person in a space and through air in said space and containing said person.

20. A method of enabling a hearer to hear desired sound while also being able to be aware of ambient sound, comprising: providing a first non-sound signal representative of said desired sound, deriving a second non-sound signal representative of said ambient sound without phase shift, combining the first and second non-sound signals in providing a combined non-sound signal, converting said combined non-sound signal into sound, and providing for the sound to be heard a single threshold, or both of a lower threshold and an upper threshold, for the volume and/or the frequency of the sound to be heard, and further comprising providing, by phase-shifting, a third non-sound signal representative of a partially cancelling, ambient sound signal, and combining the first, second and third non-sound signals in providing said combined signal.

21. A method according to claim 20, and further comprising variably adjusting said single threshold, or said lower threshold and/or said upper threshold for said second non-sound signal.

22. A method according to claim 20, and further comprising emitting an alert upon exceeding of said single threshold, or of said lower threshold and/or said upper threshold for said second non-sound signal.

23. A method according to claim 20, and further comprising variably adjusting said second non-sound signal to represent adjustment of the volume and/or frequency of said ambient sound.

24. A method according to claim 20 and further comprising providing a third non-sound signal representative of a partially cancelling, ambient sound signal, and combining the first, second and third non-sound signals in providing said combined signal.

25. A method according to claim 24 and further comprising providing a fourth non-sound signal representative of a fully cancelling ambient sound signal and combining the first, second, third and fourth non-sound signals in providing said combined signal.

26. A method according to claim 24, and in the form of selective sound cancellation of the ambient sound giving differentiation between wanted and unwanted sounds in the ambient sound.

27. A method according to claim 26, wherein said third non-sound signal has been preset before said providing thereof.

28. A method according to claim 27, wherein a user selects which sound to cancel by choosing the preset non-sound signal from among a range of differing, preset non-sound signals.

29. A method according to claim 28, wherein the preset non-sound signal comprises one or more sound-cancelling parameters.

30. A method according to claim 26, wherein a user selects which sound to cancel by varying one or more sound-cancelling parameters.

31. A method according to claim 30, wherein the one or more sound-cancelling parameters are:

amount of phase shift;
time delay;
individual frequencies;
volume;
equaliser (hi, hi-mid, mid, lo-mid, and/or lo);
compression;
gating;
spectral enhancement;
threshold;
range;
gain;
ratio;
attack;
release;
minimum;
maximum;
sensitivity,
vocal, or
reverberation or any combination thereof.

* * * * *